US011815845B2

(12) United States Patent
Miyashita et al.

(10) Patent No.: US 11,815,845 B2
(45) Date of Patent: Nov. 14, 2023

(54) IMAGE FORMING APPARATUS HAVING A ROTATABLE OPENING AND CLOSING PART

(71) Applicant: CANON KABUSHIKI KAISHA, Tokyo (JP)

(72) Inventors: Takehiro Miyashita, Kanagawa (JP); Takeo Kawanami, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 17/938,831

(22) Filed: Oct. 7, 2022

(65) Prior Publication Data

US 2023/0115329 A1 Apr. 13, 2023

(30) Foreign Application Priority Data

Oct. 11, 2021 (JP) ..... 2021-166728

(51) Int. Cl.
*G03G 21/16* (2006.01)

(52) U.S. Cl.
CPC ..... *G03G 21/1633* (2013.01); *G03G 21/1638* (2013.01); *G03G 21/1647* (2013.01); *G03G 2221/1687* (2013.01)

(58) Field of Classification Search
CPC ..... G03G 21/1623; G03G 21/1633; G03G 21/1638; G03G 21/1647; G03G 21/168; G03G 21/1695; G03G 2221/1642; G03G 2221/1675; G03G 2221/1687
See application file for complete search history.

(56) References Cited

U.S. PATENT DOCUMENTS

2006/0120756 A1* 6/2006 Ahn ..... G03G 21/1633 399/124
2021/0364948 A1* 11/2021 Munetsugu ..... G03G 15/0886
2022/0253015 A1* 8/2022 Yamada ..... G03G 21/1633
2022/0373961 A1* 11/2022 Nogami ..... G03G 21/1633

FOREIGN PATENT DOCUMENTS

JP H07244410 A 9/1995

* cited by examiner

*Primary Examiner* — Sophia S Chen
(74) *Attorney, Agent, or Firm* — Canon U.S.A., Inc. I.P. Division

(57) ABSTRACT

An image forming apparatus configured to form an image on a sheet includes a main body, an opening and closing part, a link part, and an urging member. The link part is connected to the main body and the opening and closing part. When the opening and closing part moves between open and closed positions, the link part moves perpendicular to a direction along a rotating shaft of the link part to contact and be received by the main body. The opening and closing part can move in a state in which the link part and the main body contact each other. When the opening and closing part is in the closed position, the link part and the main body are separated from each other, and the opening and closing part is urged toward the main body by the link part urged by the urging member.

10 Claims, 29 Drawing Sheets

IMAGE FORMING APPARATUS HAVING A ROTATABLE OPENING AND CLOSING PART

BACKGROUND

Field

The present disclosure relates to an image forming apparatus configured to form an image on a sheet.

Description of the Related Art

Generally, an electrophotographic image forming apparatus is configured to form an image by transferring a toner image formed on the surface of a photosensitive drum onto a recording medium. Some imaging forming apparatuses has an opening and closing part that can be opened and closed to handle a jammed recording medium, or to maintain process units, etc. In some of this type of image forming apparatus, the opening and closing part is urged against a main body of the apparatus using an urging member such as a spring (Japanese Patent Application Laid-Open No. H07-244410).

However, in the technique disclosed in Japanese Patent Application Laid-Open No. H07-244410, to stably urging the opening and closing part against the main body of the apparatus, it is necessary to increase the urging force of the urging member that urges the opening and closing part. The increase in the urging force results in an increase in operating force to open and close the opening and closing part, which may cause a reduction in usability for a user, a service person, and the like.

SUMMARY

According to an aspect of the present disclosure, an image forming apparatus configured to form an image on a sheet includes a main body including a receiving surface and a first part, an opening and closing part rotatable with respect to the main body between an open position and a closed position, a link part connected to the main body and the opening and closing part, wherein the link part includes a second part engaged with the first part and includes a contact part, and an urging member connected to the link part and the main body and configured to urge the link part, wherein the link part is rotatable about the second part with respect to the main body, wherein, when the opening and closing part moves between the open position and the closed position, the second part moves with respect to the first part in a direction perpendicular to a direction along a rotating shaft of the link part thereby causing the contact part to come into contact with the receiving surface of the main body and further causing the contact part, urged by the urging member, to be received by the receiving surface of the main body, wherein the opening and closing part is capable of moving in a state in which the contact part of the link part and the receiving surface of the main body are in contact with each other, and wherein, when the opening and closing part is in the closed position, the contact part and the receiving surface are separated from each other, and the opening and closing part is urged toward the main body by the link part urged by the urging member.

Further features of the present disclosure will become apparent from the following description of exemplary embodiments with reference to the attached drawings.

DESCRIPTION OF THE EMBODIMENTS

Aspects of the present disclosure are described in detail below with reference to embodiments in conjunction with drawings. Note that in these embodiments, specific dimensions, materials, shapes, and relative positions of parts are described by way of example but not limitation. That is, these may be properly changed as required depending on a structure of the apparatus and/or a condition thereof. That is, the scope of the present disclosure is not limited by the embodiments described below.

First Embodiment

Figure 1:
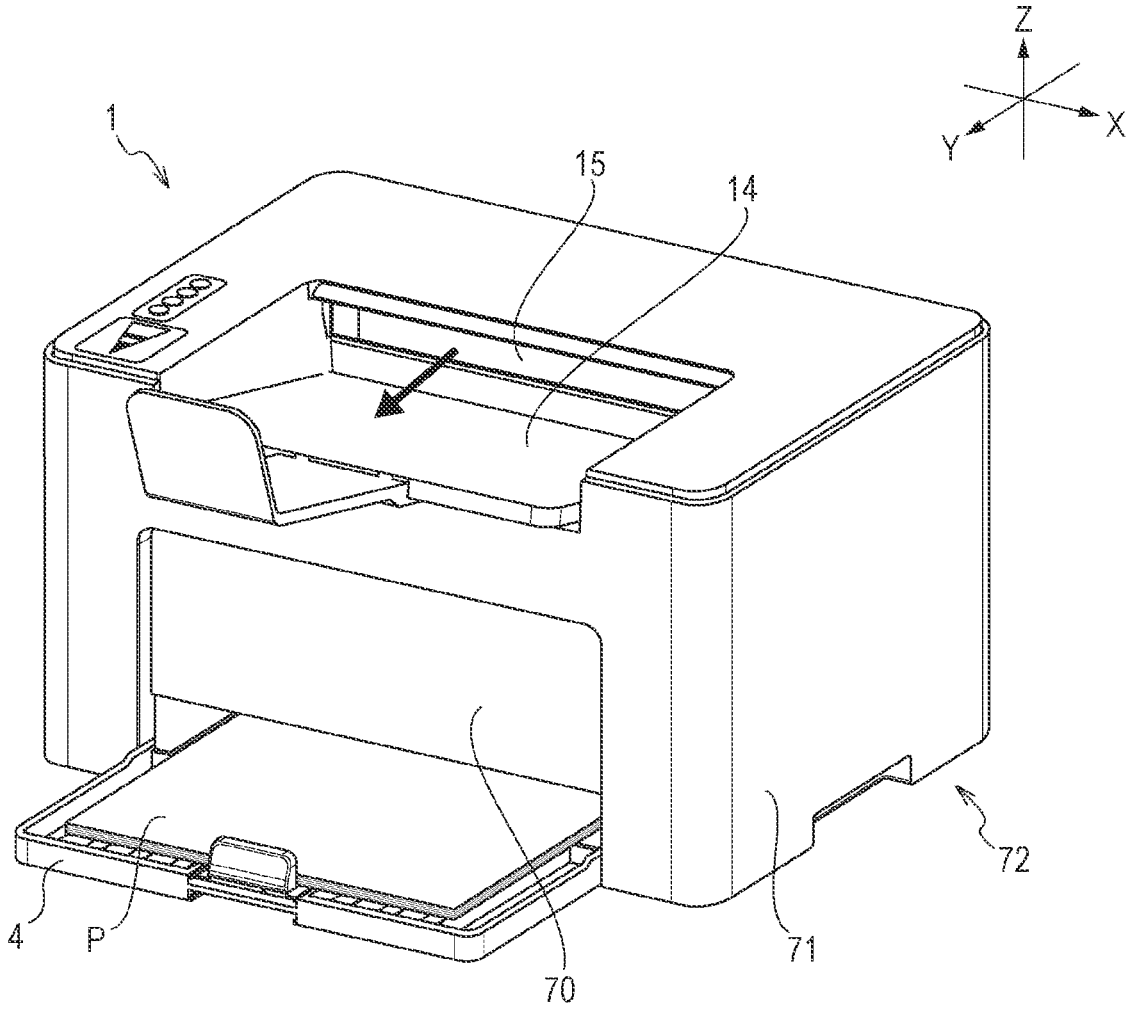
FIG. 1 is a perspective view of an image forming apparatus according to an embodiment.
Figure 2:
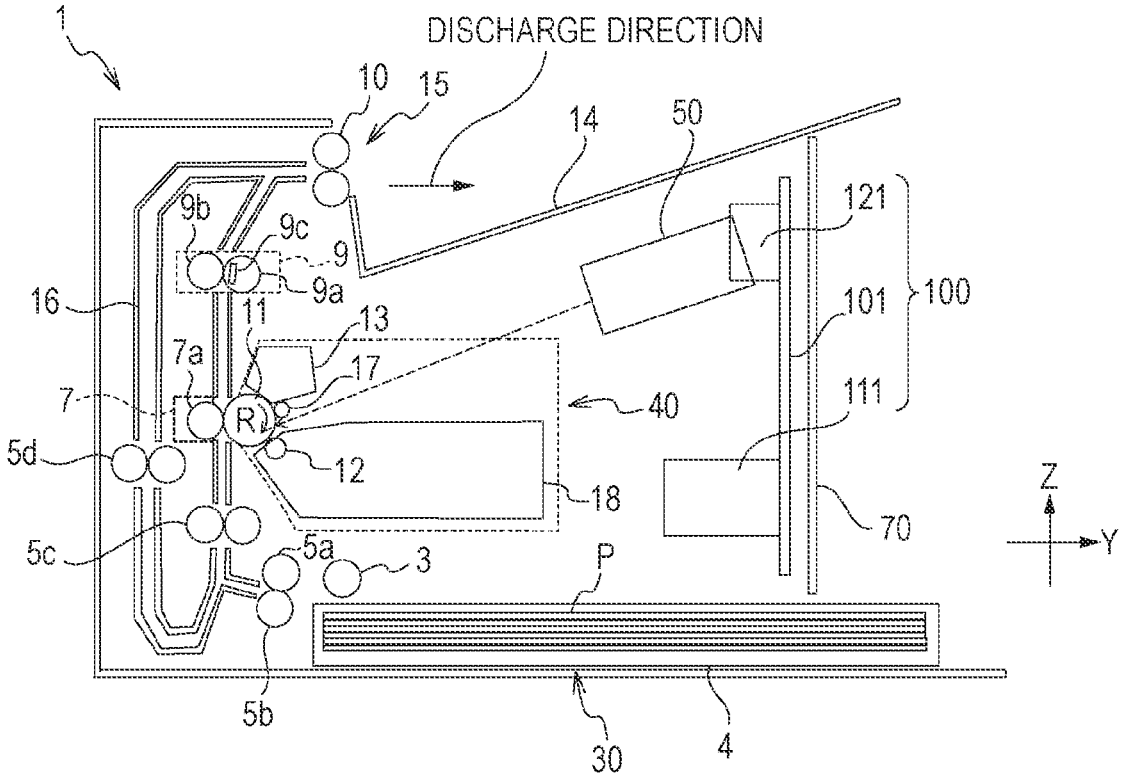
FIG. 2 is a schematic diagram illustrating an overall structure of an image forming apparatus.

FIG. 1 is a perspective view illustrating an image forming apparatus 1 according to a first embodiment. FIG. 2 is a schematic diagram illustrating a structure of the image forming apparatus 1. The image forming apparatus 1 is a monochrome printer configured to form an image on a recording medium based on image information input from an external device. Examples of recording media include paper such as plain paper, cardboard, and the like, a plastic film such as an overhead projector sheet, a sheet with a special form such as an envelope, index paper, and the like, and various types of sheets made of various materials such as cloth.

In the following description, a Z-direction is defined in a direction of the height direction (opposite to the gravity direction) of the image forming apparatus 1 when the image forming apparatus 1 is installed on a horizontal plane. An X-direction is defined in a direction that intersects the Z-direction and is parallel to a direction of a rotating shaft of a photosensitive drum 11 (a main scanning direction) which will be described later. AY-direction is defined in a direction that intersects the X-direction and Z-direction. The X-direction, the Y-direction, and the Z-direction may be perpendicular to each other. For convenience, the positive side in the X-direction is called a right side, and the negative side is called a left side. In the Y-direction, the positive side is called a front side, and the negative side is called a rear side or a back side. In the Z-direction, the positive side is called an upper side and the negative side is called a lower side.

Overall Structure

As shown in FIGS. 1 and 2, the image forming apparatus 1 includes an image forming part configured to form a toner image on a sheet P functioning as a recording medium, and a feed unit 30 configured to feed the sheet P. Furthermore, the image forming apparatus 1 also includes a fixing unit 9 configured to fix the toner image, formed by the image forming part 20, on the sheet P, and a discharge roller pair 10.

The image forming part includes a scanner unit 50, an electrophotographic process unit 40, a transfer roller 7*a* configured to transfer a toner image, formed on a photosensitive drum 11 of the process unit 40, to the sheet P. The process unit 40 includes the photosensitive drum 11, a cleaning unit 13 disposed near the photosensitive drum 11, a charging roller 17, a development roller 12, and a developer container 230 (see FIG. 8) including a supply part 200 and an accommodation unit 18 for accommodating toner. The transfer roller 7*a* is disposed in the transfer unit 7 such that the transfer roller 7*a* is urged against the photosensitive drum 11 by an urging member (not shown).

The photosensitive drum 11 functioning as an image bearing member is a photosensitive member formed in a cylindrical shape. In the present embodiment, the photosensitive drum 11 has a photosensitive layer formed of a negatively chargeable organic photosensitive material on a drum-shaped substrate molded of aluminum. The photosensitive drum 11 functioning as the image bearing member is driven by a motor to rotate in a predetermined direction (denoted by R in FIG. 2) at a predetermined process speed.

The charging roller 17 is in contact with the photosensitive drum 11 with a predetermined pressure force thereby forming a charging part. A predetermined charging voltage is applied, by a charging high-voltage power supply, to the photosensitive drum 11 such that the surface of the photosensitive drum 11 is uniformly charged to a predetermined potential. In the present embodiment, the photosensitive drum 11 is charged to a negative potential by the charging roller 17.

The scanner unit 50 scans and exposes the surface of the photosensitive drum 11 by irradiating, via a polygon mirror, the photosensitive drum 11 with laser light according to image information input from an external device. As a result of the exposure, an electrostatic latent image is formed on the surface of the photosensitive drum 11 in accordance with the image information. The scanner unit 50 is not limited to the laser scanner apparatus. For example, an LED exposure apparatus having an LED array including a plurality of LEDs arranged along the longitudinal direction of the photosensitive drum 11 may be used.

Figure 3:
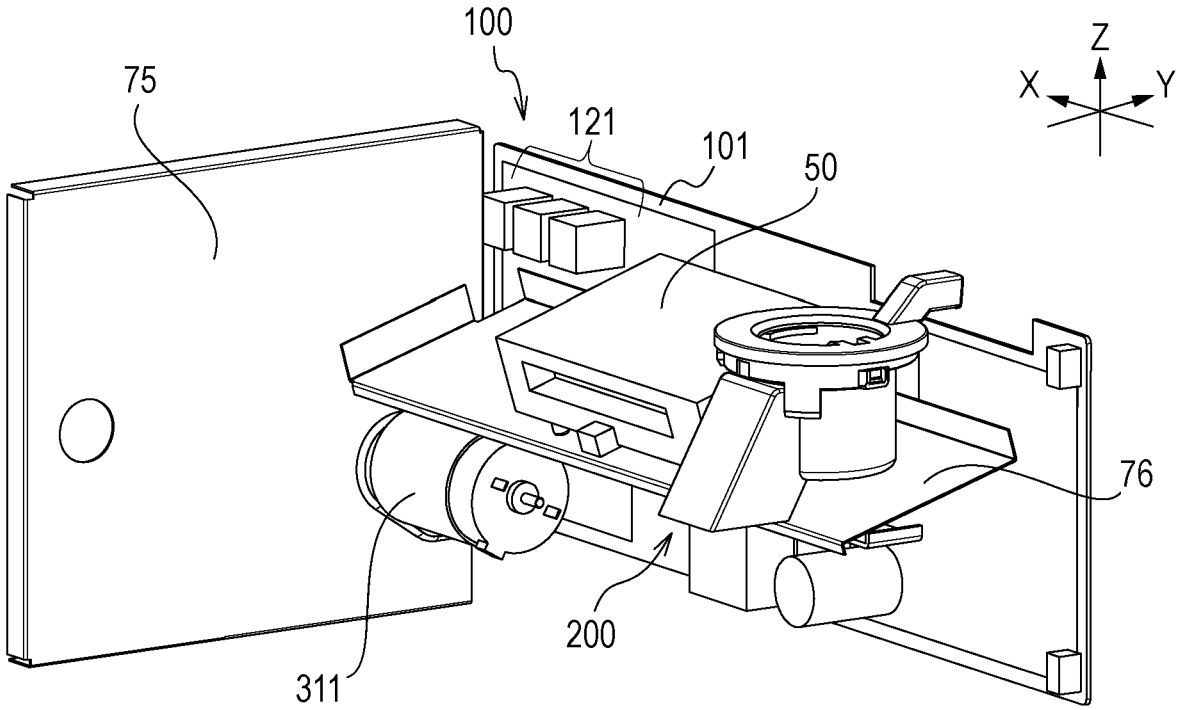
FIG. 3 is a perspective view illustrating a holding part of a scanner unit.

FIG. 3 shows a method of holding the scanner unit 50. The scanner unit 50 is held by a scanner holding member 76. The scanner holding member 76 is fixed to a right side plate frame 75 and left side plate frame 74 (not shown in FIG. 3), respectively, and extends under the supply part 200 to bridge between the two frames. A driving motor 311 is mounted on the right side plate frame 75. A gear connected to the driving motor 311 is disposed on the positive side (right side) in the X-direction of the right side plate frame 75. The driving force of the driving motor 311 is transmitted via this gear to the feeding roller 5*a* and the photosensitive drum 11.

The development roller 12 is rotatably supported by the accommodation unit 18 serving as a toner accommodation unit. The development roller 12 is disposed at an opening of the developer container 230 (see FIG. 8) including the accommodation unit 18 such that development roller 12 faces the photosensitive drum 11. The accommodation unit 18 may include a supply roller configured to apply toner, which is a developer and is accommodated in the accommodation unit 18, to the surface of the development roller 12.

In the present embodiment, the process unit 40 uses a contact developing method as the development method.

That is, the toner layer born on the development roller 12 gets into contact with the photosensitive drum 11 at a developing portion (developing area) where the photosensitive drum 11 faces the development roller 12. A developing voltage is applied to the development roller 12 by a high-voltage developing power supply. While being applied with the developing voltage, the toner born on the development roller 12 is transferred from the development roller 12 to the surface of the drum according to the potential distribution on the surface of the photosensitive drum 11. As a result, an electrostatic latent image is developed into a toner image.

In the present embodiment, the toner is a so-called non-magnetic single-component developer that does not contain a magnetic material component, and the toner is born on the development roller 12 mainly by intermolecular forces and electrostatic force (mirror image force). However, a single-component developer containing a magnetic material component may be used. The single-component developer may contain, in addition to the toner particles, additives (for example, waxes and silica particles) to adjust toner flowability and charging performance. A two-component developer containing a non-magnetic toner and a magnetic carrier may also be used as the developer. When a magnetic developer is used, for example, a cylindrical developing sleeve with a magnet disposed inside may be used as the developer carrier.

The fixing unit 9 is of a heat fixing type that heats and melts the toner on the sheet P thereby fixing the image. The fixing unit 9 includes a heating film 9*a* including a fixing heater 9*c* and a pressure roller 9*b* that is in pressure contact with the heating film 9*a*.

The feed unit 30 includes a cassette 4 on which sheets S are stacked, a pickup roller 3 functioning as a conveying part, a feeding roller 5*a*, and a separation roller 5*b*. A front cover 70 is provided on a part of an end face on the front side of the image forming apparatus 1 such that the front cover 70 covers a circuit board 100. The housing 72 includes the front cover 70, a discharge tray 14, a rear cover 73 (see FIG. 17), and an exterior cover 71 constituting the exterior of the image forming apparatus 1 other than the above. The housing 72 has a discharge port 15 through which sheets are discharged to the discharge tray 14.

As shown in FIG. 2, the image forming apparatus 1 includes the circuit board 100. The circuit board 100 includes a wiring board 101 made of an insulator, and electronic components 111 and 121 soldered to the wiring board 101. Conductor wirings are provided on and inside the wiring board 101 such that the electronic components 111 and 121 are electrically connected. The circuit board 100 has a function of converting an alternating current supplied from the outside of the image forming apparatus 1 into a direct current, and converting an input voltage to a predetermined voltage necessary for the image forming process.

The circuit board 100 is arranged such that the surface of wiring board 101 on which electronic components 111 and 121 are mounted intersects the discharge direction. The wiring board 101 is located, in the discharge direction, between the front cover 70 and the scanner unit 50. The electronic components 111 and 121 are located on the surface, of wiring board 101, facing the scanner unit 50.

Next, an image forming operation of the image forming apparatus 1 is described. When an image forming instruction is input to the image forming apparatus 1, the image forming part starts the image forming process based on image information input from an external computer connected to the image forming apparatus 1. The scanner unit 50 irradiates the photosensitive drum 11 with laser light based on the input image information. The photosensitive drum 11 has been charged in advance by the charging roller 17, and thus the irradiation of the laser light causes an electrostatic latent image to be formed on the photosensitive drum 11. After that, the electrostatic latent image is developed by the development roller 12, and thus a toner image is formed on the photosensitive drum 11.

In parallel with the image forming process described above, the pickup roller 3 of the feed unit 30 feeds out the sheet P supported on the cassette 4. One of sheets S is separated from the other by the feeding roller 5*a* and the separation roller 5*b* and is conveyed to a conveying roller pair 5*c*. The sheet P is then conveyed by the conveying roller pair 5*c* functioning as the conveying part toward a transfer nip functioning as the image forming part realized by the transfer roller 7*a* and the photosensitive drum 11.

A transfer voltage is applied to the transfer roller 7*a* from a transfer high-voltage power supply, and the toner image born on the photosensitive drum 11 is transferred onto the sheet P conveyed by the conveying roller pair 5*c*. The sheet P having the transferred toner image is conveyed to the fixing unit 9, and the toner image is heated and pressed when the sheet P passes through the nip portion between the heating film 9*a* and the pressure roller 9*b* of the fixing unit 9. As a result, the toner particles are melted and then fixed, and thus the toner image on the sheet P is fixed. After passing through the fixing unit 9, the sheet P is discharged to the outside of the image forming apparatus 1 via the discharge port 15 by the discharge roller pair 10 and stacked on the discharge tray 14.

In a case where images are formed on both sides of the sheet P, after an image is formed on the first side of the sheet P, the sheet P is switched back by the discharge roller pair 10 thereby being guided to the double-sided conveying path 16.

The sheet P guided by the double-sided conveying path 16 is again conveyed toward the transfer roller 7*a* by the double-sided conveying roller pair 5*d*. After an image is formed on the second side of the sheet P by the transfer roller 7*a*, the sheet P is discharged outside the apparatus by the discharge roller pair 10.

Although in the present embodiment, the image forming apparatus 1 is configured to be capable of forming images on both sides of a sheet P using the double-sided conveying path 16, the image forming apparatus 1 is not limited to this example. For example, the image forming apparatus 1 may not include the double-sided conveying path 16 and may be capable of forming an image only on one side of the sheet P.

Control Blocks

Figure 4:
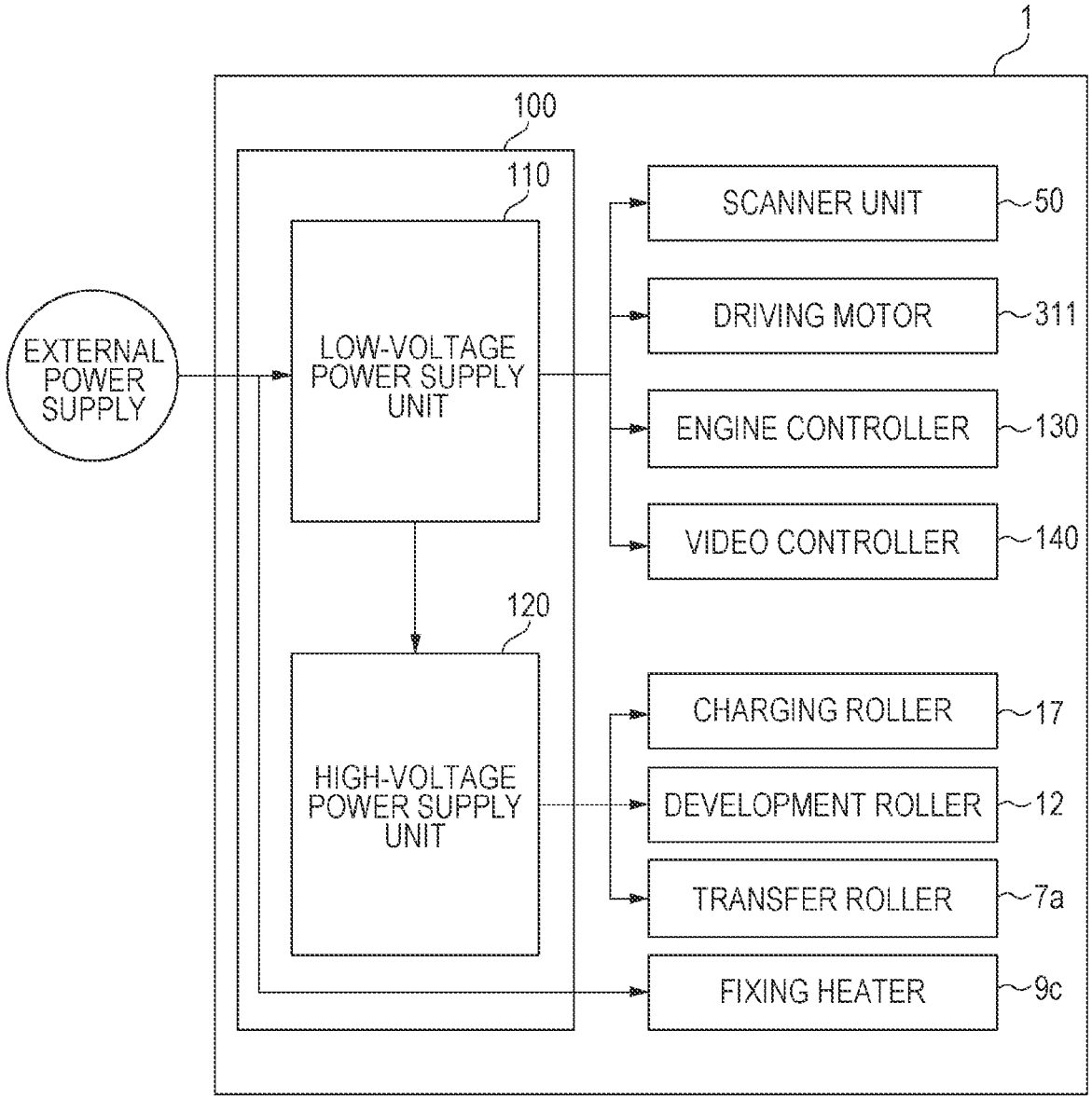
FIG. 4 is a block diagram for explaining functions of a power supply board.

FIG. 4 is a block diagram for explaining the functions of the circuit board 100 according to the present embodiment. The circuit board 100 includes a low-voltage power supply unit 110 and a high-voltage power supply unit 120. The low-voltage power supply unit 110 takes in power from an external power supply via a power supply input unit (not shown) mounted on an end of the circuit board, and converts an AC voltage into a stable DC voltage by a rectifying and smoothing circuit including an electrolytic capacitor. After that, the low-voltage power supply unit 110 converts the DC voltage into a high-frequency AC voltage using a switching element such as a transistor, and supplies the high-frequency AC voltage to a low-voltage power transformer. The low-voltage power transformer converts the input high-frequency AC voltage into an AC voltage (an output voltage) having a predetermined voltage value. The low-voltage power supply unit 110 again converts the AC voltage to a DC voltage and outputs the obtained DC voltage to the high-voltage power supply unit 120. In the low-voltage power supply unit 110, losses occurring in various circuit components cause heat to occur. To dissipate the heat, a heat sink (not shown) made of aluminum or iron is provided.

The high-voltage power supply unit 120 converts the voltage (of, for example, 24 V) supplied from the low-voltage power supply unit 110 to a high voltage necessary for image forming processes such as charging, developing, and transferring, and/or the like. The voltage supplied from the low-voltage power supply unit 110 is converted to a charging voltage by a charging transformer and supplied to the charging roller 17. The voltage supplied from the low-voltage power supply unit 110 is converted to a voltage for development by a development transformer and supplied to the development roller 12. The voltage supplied from the low-voltage power supply unit 110 is converted to a transfer voltage by a transfer transformer and supplied to the transfer roller 7*a*.

The low-voltage power supply unit 110 supplies voltages (of, for example, 3.3 V or 5 V), not only to the high-voltage power supply unit 120, but also to the scanner unit 50, the driving motor 311, the engine controller 130, and the video controller 140. The engine controller 130 functions as a control unit that comprehensively controls various processing units. The engine controller 130 includes a CPU (not shown), a RAM (not shown) used in calculating or temporarily storing data necessary for controlling the image forming apparatus 1, and a ROM (not shown) that stores a program and various data for controlling the image forming apparatus 1, and/or the like.

The video controller 140 receives print data by communicating with an external device such as a personal computer, and sends a result of analyzing the print data to the engine controller 130. Note that the engine controller 130 and the video controller 140 may be provided on a circuit board different from the circuit board 100, or may be provided on the circuit board 100.

The AC power from a commercial power supply received by the power supply input unit is supplied not only to low-voltage power supply unit 110 but also to the fixing heater 9*c*. Driving the roller and other parts of the fixing unit 9 is performed by the driving motor 311.

Positioning of Process Unit

Positioning of the process unit 40 that is detachably mounted on the image forming apparatus 1 is described. Details regarding attachment and detachment of the process unit 40 will be described later.

Figure 5:
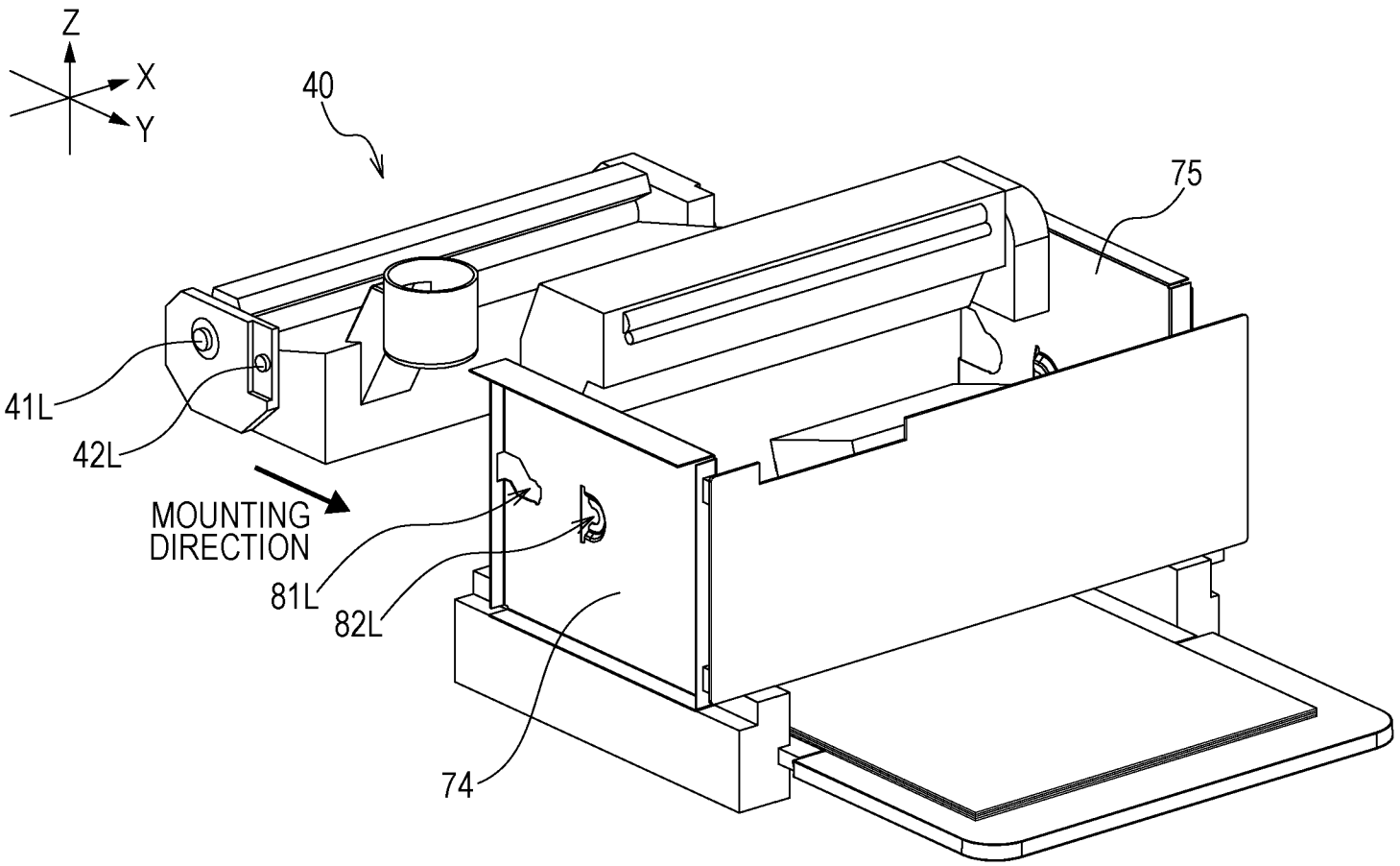
FIG. 5 is a perspective view of an image forming apparatus in a state in which a process unit is going to be mounted on the image forming apparatus.

FIG. 5 is a perspective view of the image forming apparatus 1 configured such that the process unit 40 is mounted from the back side in a direction toward the front side, wherein FIG. 5 illustrates the state before the process unit 40 is mounted. The process unit 40 has a left positioning boss 41L (a positioning structure) and a left rotation restriction boss 42L (a rotation restriction structure) on the left side, and similarly has a right positioning boss and a right rotation restriction boss (not shown) on the right side.

In the present embodiment, the positioning structure and the rotation restriction structure are realized by bosses, but the positioning structure and the rotation restriction structure are not limited to the bosses. The image forming apparatus 1 also has a left side plate frame 74 and a right side plate frame 75 made of sheet metal. The left side plate frame 74 has a left positioning part 81L and a left rotation restriction part 82L respectively corresponding to the left positioning boss 41L and the left rotation restriction boss 42L on the left side of the process unit 40.

The right side plate frame 75 has a right positioning part 81R (not shown) and a right rotation restriction part 82R respectively corresponding the right positioning boss 41R and the right rotation restriction boss 42R on the right side of the developing process unit 40. By providing the positioning part and the rotation restriction part on the same sheet metal in the above-described manner, the cumulative tolerance is reduced, and it becomes possible to perform positioning at a desired position with high accuracy.

Figure 6A:
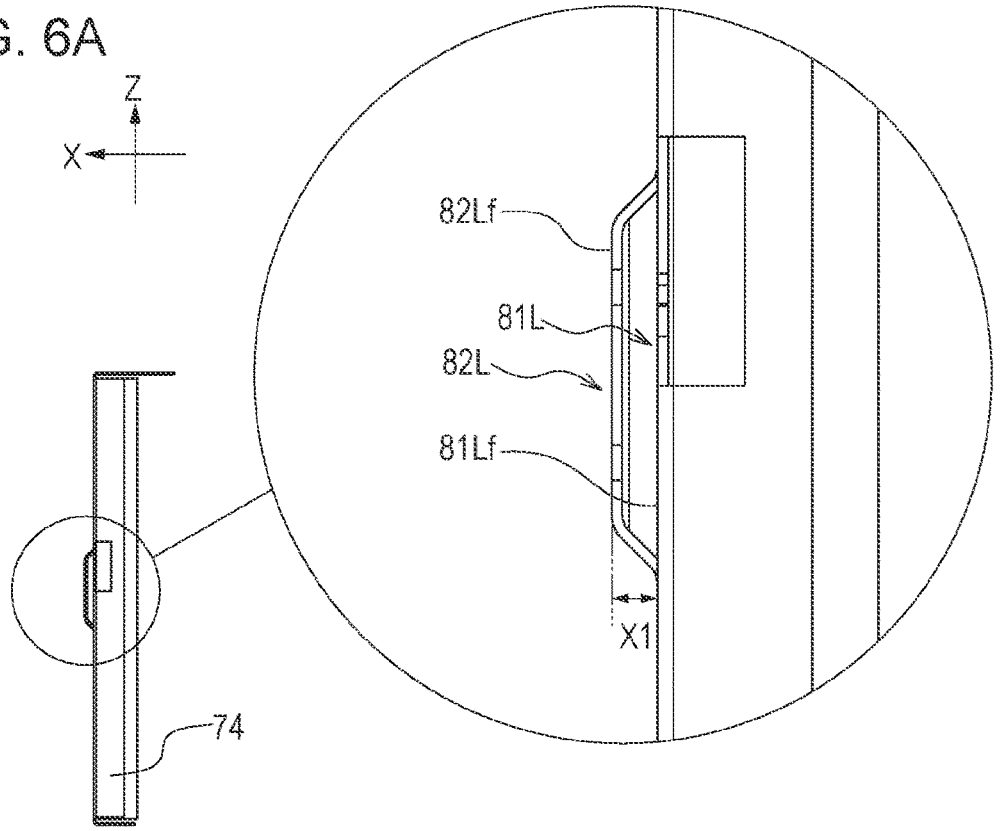
FIGS. 6A and 6B are rear views of a left side plate frame and a right side plate frame for illustrating a positioning part and a rotation restriction part.
Figure 6B:
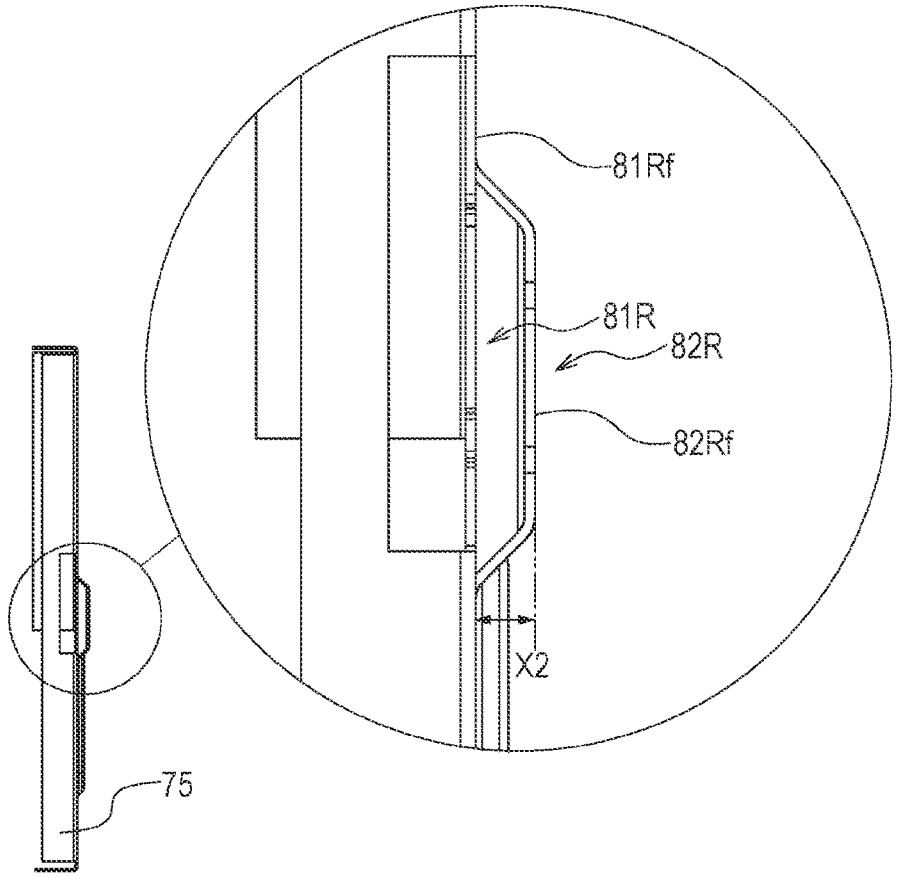

FIG. 6 is a rear view of the left side plate frame 74 and the right side plate frame 75 for explaining the positioning parts 81L,81R and the rotation restriction parts 82L,82R. In the image forming apparatus 1 according to the present embodiment, the developing process unit 40 is attached from the back side to the front side, and thus the rear view provides a view seen from the attachment direction.

There is a difference X1 in the X-direction between a left first surface part 81Lf and a left second surface part 82Lf wherein the left first surface part 81Lf has the left positioning part 81L of the left side plate frame 74, and the left second surface part 82Lf has the left rotation restriction part 82L. Similarly, there is a difference X2 in the X-direction between a right first surface part 81Rf and a right second surface part 82Rf wherein the right first surface part 81Rf has the right positioning part 81R of the right side plate frame 75, and the right second surface part 82Rf has the right rotation restriction part 82R. That is, on the left side plate frame 74 and the right side plate frame 75, the first surface part 81*f* and the second surface part 82*f* are not on the same plane. The second surface part 82*f* is formed by drawing the left side plate frame 74 or the right side plate frame 75.

Figure 7:
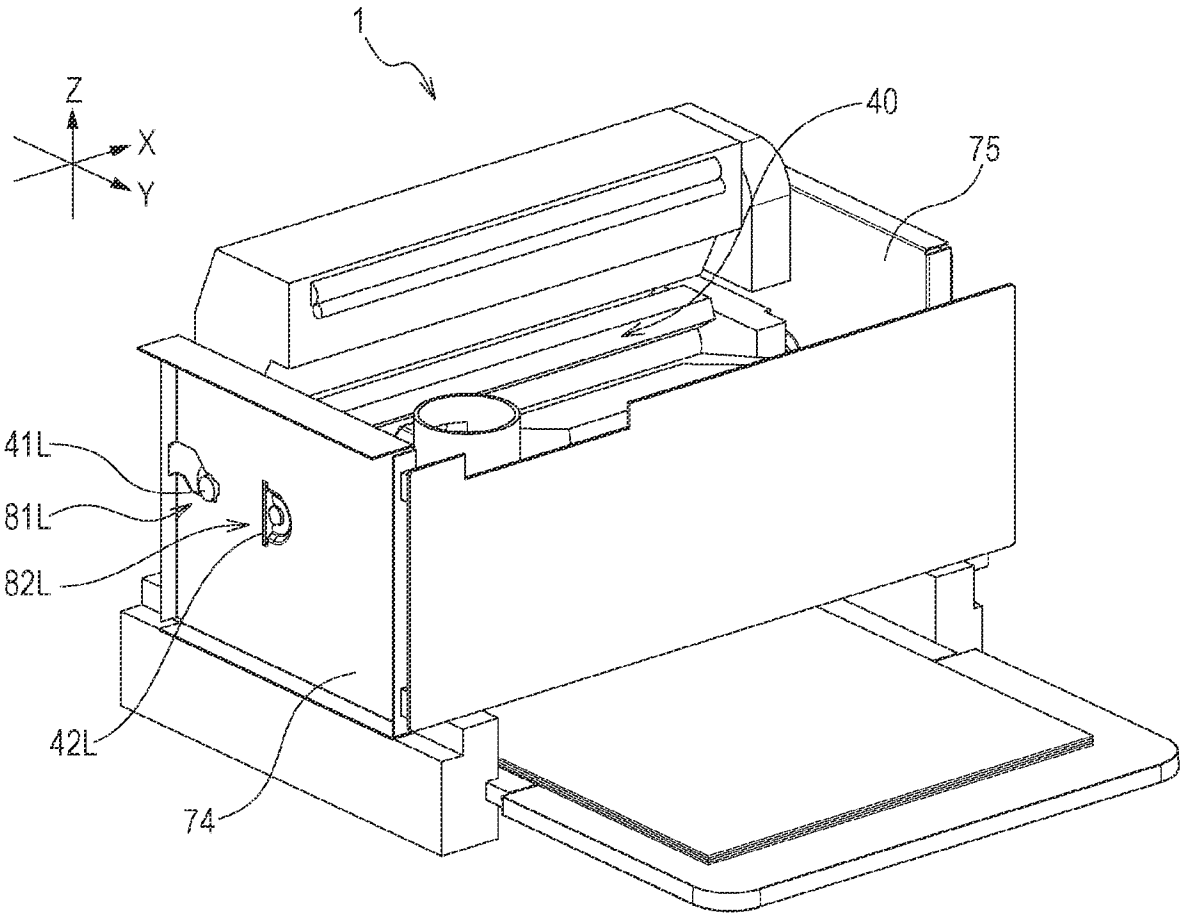
FIG. 7 is a perspective view of an image forming apparatus for illustrating a process unit and a frame positioning part.

FIG. 7 is a perspective view of the image forming apparatus 1 having the process unit 40 mounted on the image forming apparatus 1. When the process unit 40 is mounted, the process unit 40 is fixed from the back side to the front side by left and right fixing members 79 which will be described later. As shown in FIG. 7, when the process unit 40 is mounted on the image forming apparatus 1, the left positioning boss 41L and the left rotation restriction boss 42L on the left side of the process unit 40 are respectively engaged with the left positioning part 81L and the left rotation restriction part 82L of the left side plate frame 74 such that they are fixed at predetermined positions. Although not shown, the right positioning boss 41R and the right rotation restriction boss 42R on the right side of the process unit 40 are respectively engaged with the right positioning part 81R and the right rotation restriction part 82R of the right side plate frame 75 such that they are fixed at predetermined positions.

Developer Container

Figure 8:
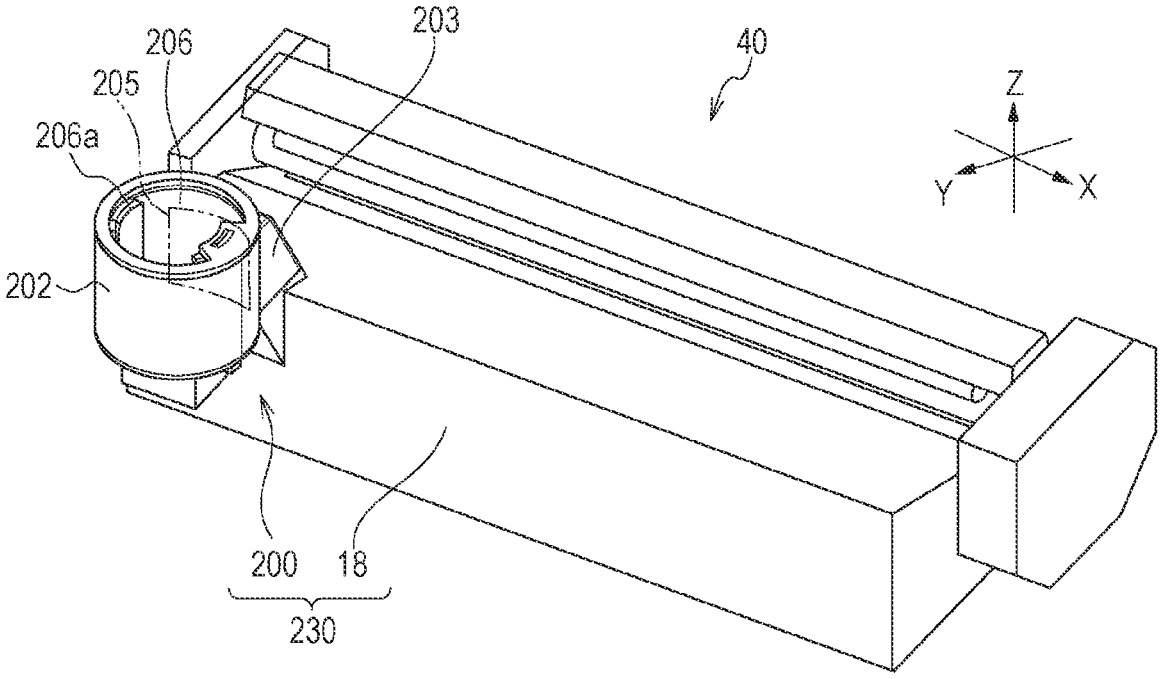
FIG. 8 is a perspective view of a developer container.

Next, the developer container 230 and its peripheral parts are described with reference to FIGS. 8 and 9. As shown in FIG. 8, the developer container 230 includes the accommodation unit 18, and the supply part 200 functioning as a mounting part and a receiving part. The supply part 200 includes an operation unit 201, a cylindrical toner receiving part 202, a supply path part 203 connecting the toner receiving part 202 and the accommodation unit 18, and a main body shutter part 206 functioning as a main body shutter. A side opening 205 leading to the supply path part 203 is formed in the inner wall of the toner receiving part 202.

Figure 9:
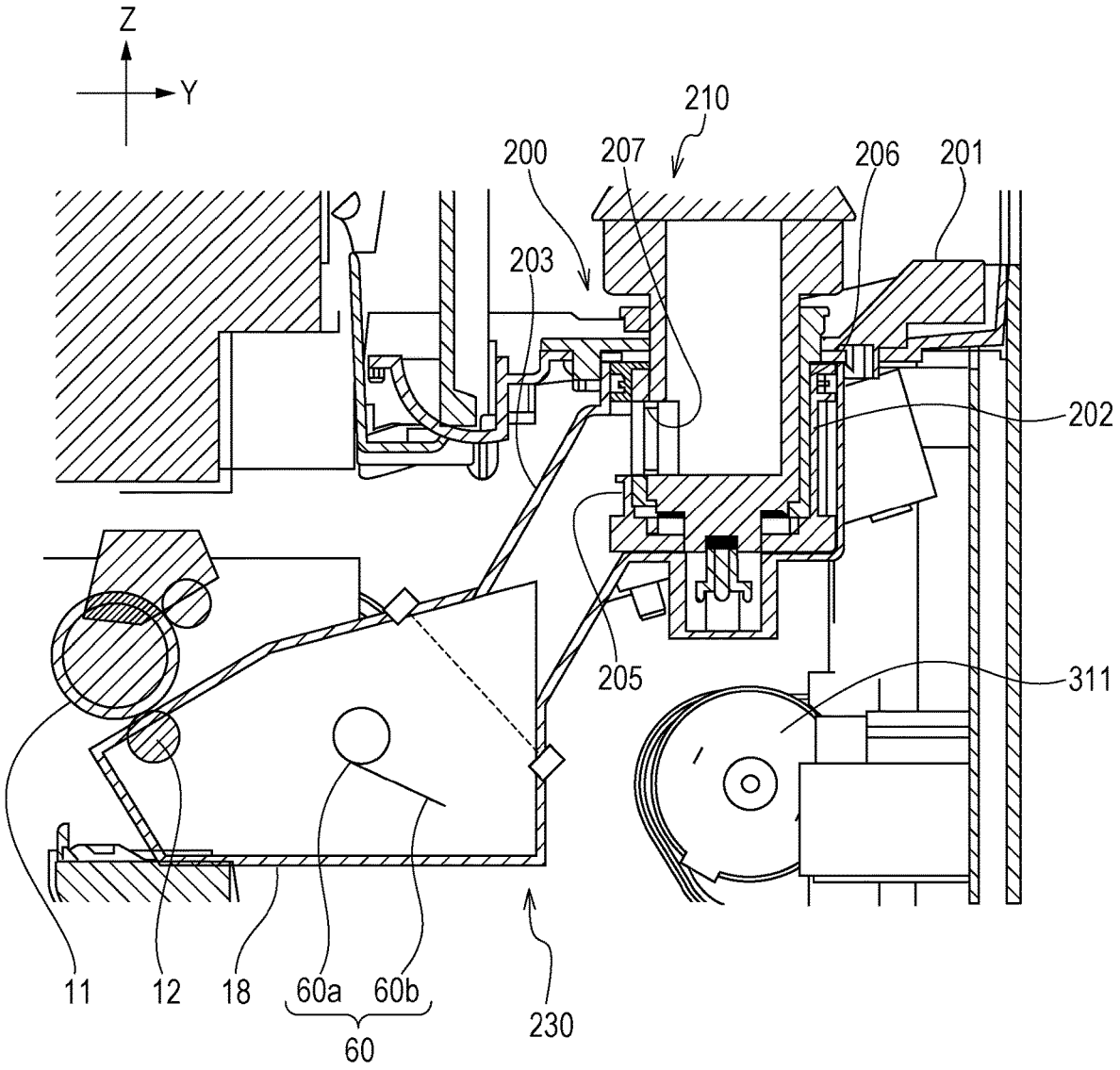
FIG. 9 is a cross-sectional view illustrating a supply part and a developer container.

As shown in FIG. 9, a supply pack 210, which will be described later, is attached to the supply part 200 (see FIG. 11). Toner supplied from supply pack 210 is supplied to the accommodation unit 18 via an opening 207 of the main body shutter part 206, the side opening 205 of the toner receiving part 202, and the supply path part 203.

As shown in FIG. 9, the supply path part 203 is connected to one end side of the accommodation unit 18 in the longitudinal direction of the developer container 230, that is, in the X-direction. As shown in FIG. 9, a stirring member 60 that rotates about a rotating shaft 60*a* extending in the X-direction is provided inside the accommodation unit 18.

The stirring member 60 includes a blade part 60*b* fixed to the rotating shaft 60*a*. The stirring member 60 is driven by the driving motor 311 to rotate, thereby stirring the toner in the accommodation unit 18 and conveying the toner toward the development roller 12. In the present embodiment, the stirring member 60 includes the rotating shaft 60*a* and the blade part 60*b*, but a helical stirring member may be used to spreading the toner over the entire length of the accommodation unit 18.

The stirring member 60 also has a role of circulating toner returned from the development roller 12 without being used in the development within the accommodation unit 18 thereby uniformizing the toner within the accommodation unit 18. Note that the stirring member 60 is not limited to rotating. For example, a stirring member that swings may be employed. Furthermore, in addition to the stirring member 60, another stirring member may be provided.

Supply Part

Figure 10A:
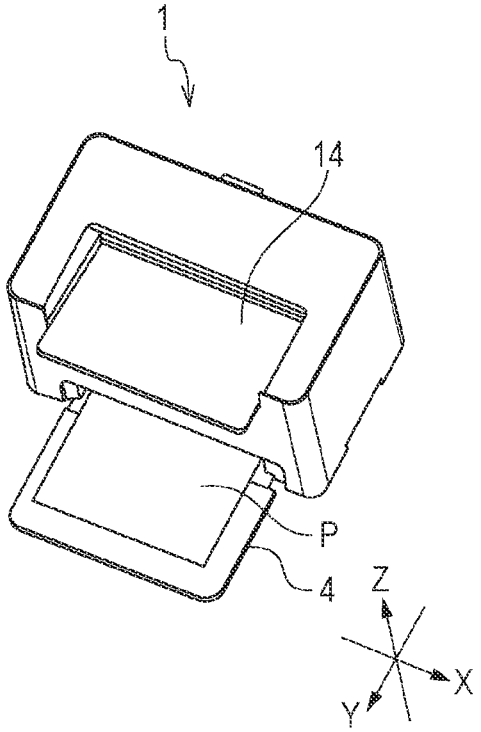
FIGS. 10A, 10B, and 10C are perspective views of an image forming apparatus seen from the above.
Figure 10B:
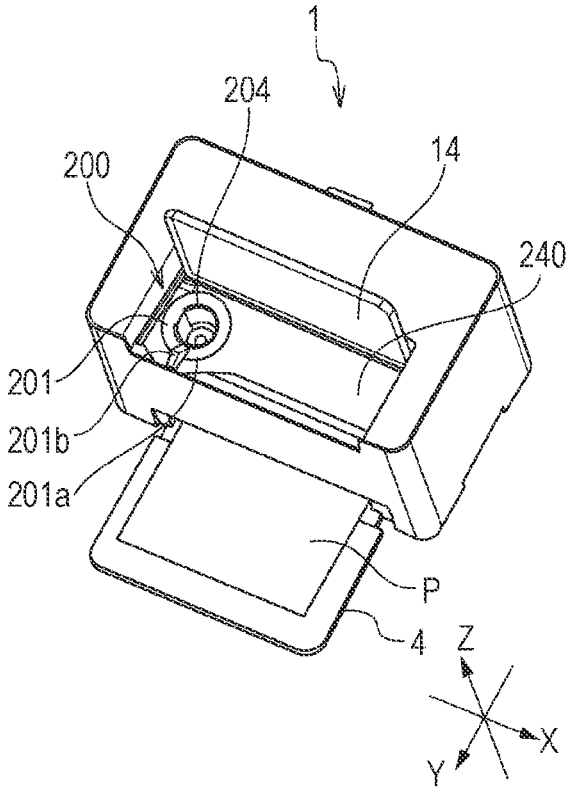

Next, the supply part 200 is described with reference to FIGS. 10A to 10C and FIGS. 11A to 11C. The discharge tray 14 is supported so as to be opened/closed between a closed position shown in FIG. 10A at which sheets S are allowed to be stacked on the discharge tray 14 and an open position where the discharge tray 14 is open with respect to the main body of the apparatus of the image forming apparatus 1 as shown in FIG. 10B. In the closed position, the discharge tray 14 covers the supply part 200. When the discharge tray 14 is opened to the open position, the top surface part 240 and the supply part 200 disposed on the top surface part 240 are exposed.

Figure 10C:
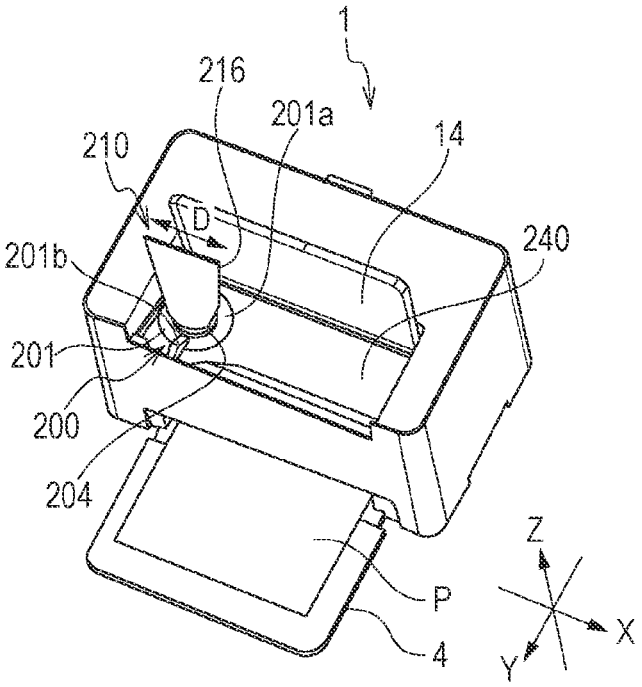

As shown in FIG. 10C, the supply pack 210 can be detachably attached to the supply part 200. This makes it possible for a user or a service person to replenish toner from the outside without removing the developer container 230 from the housing 72. In order to achieve improved usability, the supply part 200 is disposed on the front side of the main body with respect to a drum shaft where the cassette 4 is located such that toner and sheets S can be supplied from the same side.

As shown in FIGS. 10B to and 10C, the operation unit 201 functioning as an operation member is disposed on the top surface part 240 so as to form a supply opening 204 functioning as a receiving opening via which toner is replenished. As seen in the X-direction, the width of the supply opening 204 is smaller than the width of the accommodation unit 18. The operation unit 201 is formed so as to surround the supply opening 204, and includes a ring part 201*a* rotatably supported by the top surface part 240 or the toner receiving part 202, and a lever part 201*b* formed integrally with the ring part 201*a*. The operation unit 201 is a part for operating, from the outside, the main body shutter part 206 and the pack shutter part 214 to open and close them.

Figure 11A:
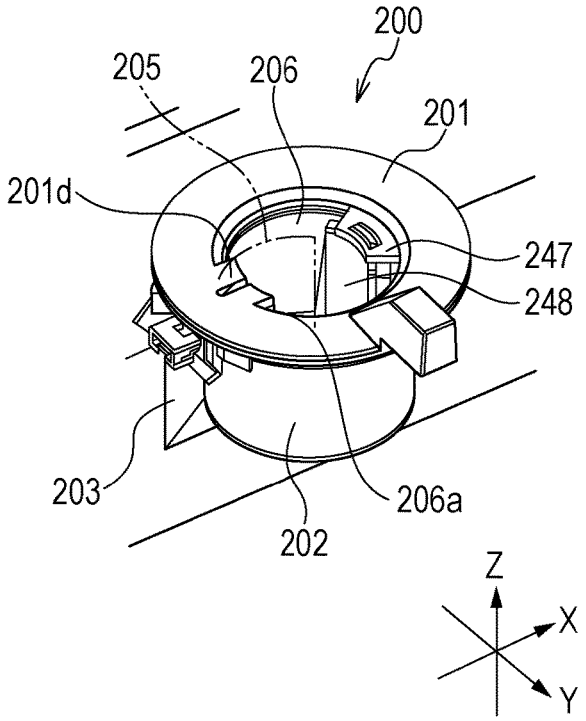
FIGS. 11A, 11B, and 11C are perspective views illustrating a supply part and nearby parts.
Figure 11B:
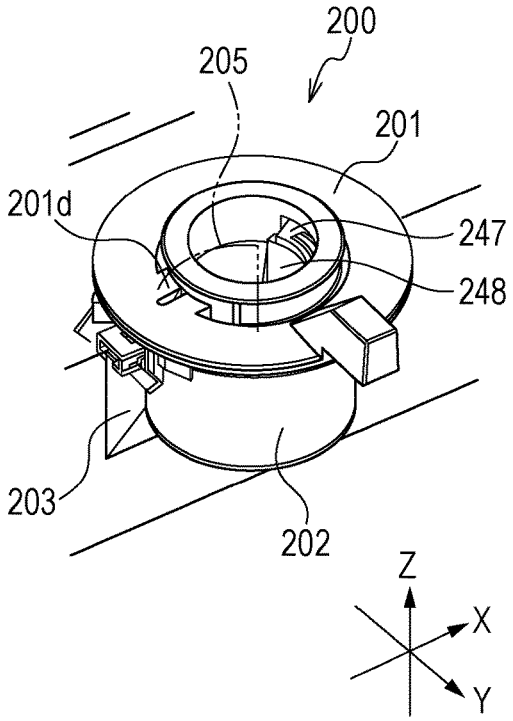

As shown in FIG. 11A, in the toner receiving part 202 and below the main body shutter part 206, guide parts 247 and 248 are formed integrally with the toner receiving part 202. The main body shutter part 206 is a cylindrical member that is concentric with the toner receiving part 202 and is rotatably disposed inside the toner receiving part 202. The main body shutter part 206 has an opening 207 (see FIG. 11C). In the closed position shown in FIG. 11A, the opening 207 and the side opening 205 of the toner receiving part 202 are displaced from each other. A seal member 243 is fixed to the main body shutter part 206 so as to surround the peripheral portion of the opening 207.

Note that the side opening 205 is covered by the main body shutter part 206 in the closed position, and thus the side opening 205 is represented by a broken line in FIG. 11A. That is, the side opening 205 is covered by main body shutter part 206 and thus the toner is not discharged to the supply path part 203.

Figure 11C:
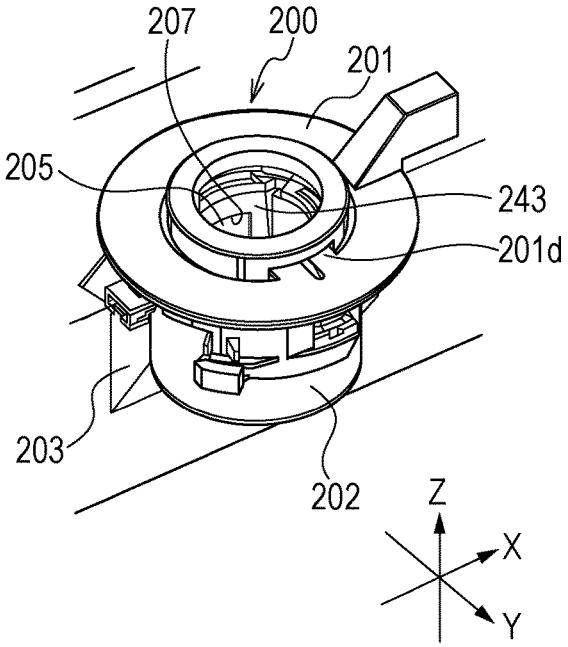

When the main body shutter part 206 is in the open position shown in FIG. 11C, the opening 207 overlaps the side opening 205 of the toner receiving part 202. Thus, in this position, toner supplied from the supply pack 210 (see FIG. 10C) attached to the supply part 200 can be discharged to the supply path part 203 via the side opening 205 and the opening 207.

The main body shutter part 206 has a main body shutter drive transmission protrusion 206*a* (see FIG. 8). When the main body shutter drive transmission protrusion 206*a* receives a drive force from the supply pack 210, the main body shutter part 206 is rotated, as will be described later in further detail. When the operation unit 201 is operated to be rotated in the state in which supply pack 210 is attached to the supply part 200, the main body shutter part 206 is moved between the closed position and the open position.

The operation unit 201 has an operation unit drive transmission protrusion 201*d* protruding radially inward from the inner circumferential surface of the toner receiving part 202. The operation unit drive transmission protrusion 201*d* is engaged with the main body shutter drive transmission protrusion 206*a* via a pair of drive transmission surfaces 214*b* (see FIG. 14B) of the pack shutter part 214 of the supply pack 210. When the lever part 201*b* of the operation unit 201 is operated by a user so as to be rotated in a counterclockwise direction by 90 degrees from the closed position shown in FIG. 11A, the main body shutter part 206 moves into the open position shown in FIG. 11C.

When an image is formed on the sheet P, it is necessary to close the side opening 205 by the main body shutter part 206 such that the toner stirred in the accommodation unit 18 by the stirring member 60 (see FIG. 9) does not leak out from the side opening 205.

Therefore, during the image forming process, the operation unit 201 is positioned in the operation position shown in FIG. 11A such that the main body shutter part 206 is in the closed position. On the other hand, when toner is replenished from the supply pack 210 (described later) to the accommodation unit 18, it is necessary to open the side opening 205. Therefore, when toner is replenished, the operation unit 201 is in the replenishment position shown in FIG. 11C such that the main body shutter part 206 is in the open position.

Structure and Arrangement of Supply Part

Figure 12:
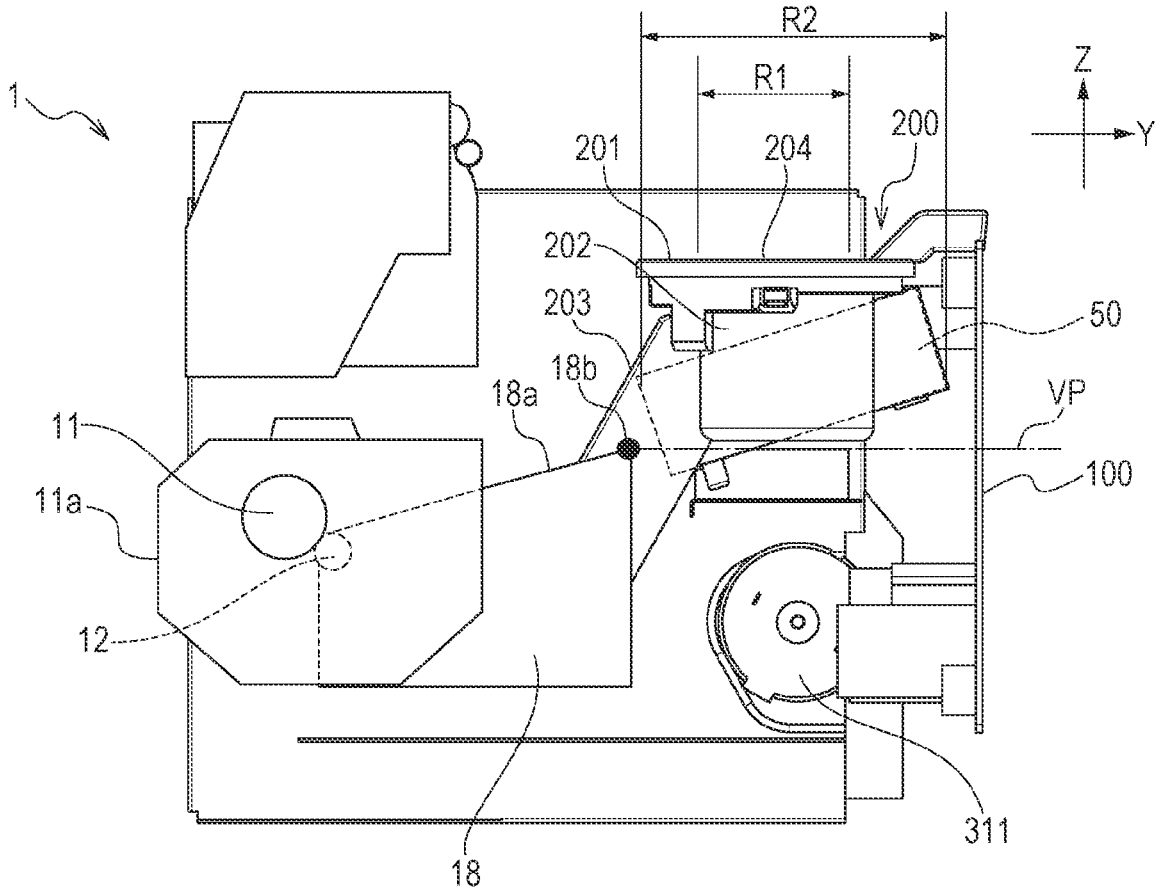
FIG. 12 is a cross-sectional view illustrating a manner in which a supply part is disposed.

Next, the arrangement of the supply part is described. FIG. 12 is a left side view of the image forming apparatus 1 as seen from the direction along the rotating shaft of the photosensitive drum 11. In FIG. 12, the exterior cover 71 and the left side plate frame 74 are not shown.

A part of the scanner unit 50 overlaps the supply part 200 and is not actually visible, and such an invisible area is represented by broken lines in FIG. 12. More specifically, in the supply part 200, the toner receiving part 202 and the supply path part 203 overlap the scanner unit 50. That is, the toner receiving part 202 and the supply path part 203 are at locations which overlap the scanner unit 50 in the Z-direction.

Here let R1 denote a region where the supply opening 204 is located in the Y-direction (the horizontal direction), and let R2 denote a region where the scanner unit 50 is located in the Y-direction, then there is overlapping between R1 and R2.

Let VP denote a virtual plane parallel to the horizontal plane and passing through an uppermost end portion 18*b* of a frame 18*a* of the accommodation unit 18. In FIG. 12, the virtual plane VP is represented by a dashed line. With reference to the virtual plane VP, part of the supply part 200 is located on the positive side (upper side) in the Z-direction.

In other words, part of the supply part 200 protrudes upward with respect to the uppermost end portion 18*b* of the accommodation unit 18. More specifically, such part of the supply part 200 includes the entire operation unit 201, part of the toner receiving part 202, and part of the supply path part 203. The part of the toner receiving part 202 and the part of the supply path part 203 that protrude upward beyond the virtual plane VP overlap the scanner unit 50.

As shown in FIG. 12, part of the accommodation unit 18 overlaps the drum frame part 11*a* that supports the photosensitive drum 11 and is not actually visible, and thus such part is represented broken lines.

The accommodation unit 18 supports the development roller 12 carrying the developer, and the development roller 12 is also at a location not actually visible, and thus the development roller 12 is also represented by a broken line.

Figure 13:
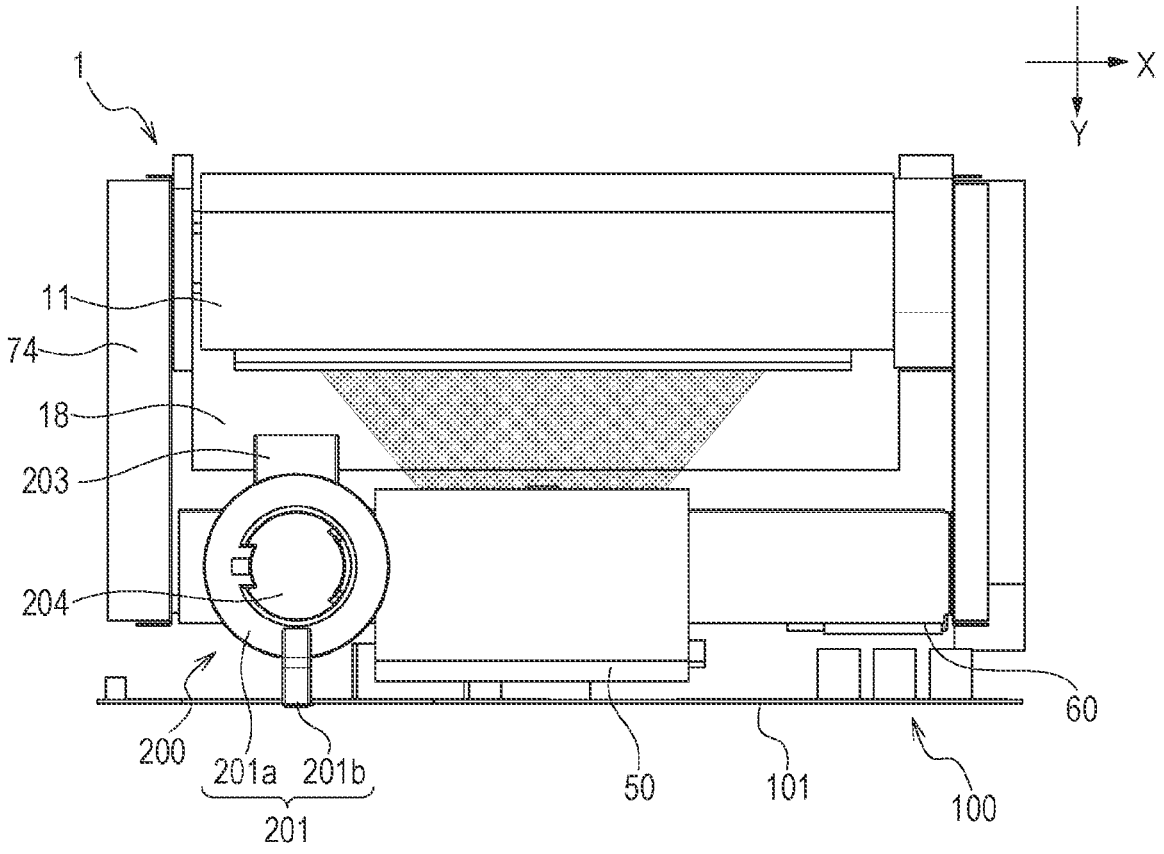
FIG. 13 is a top view illustrating a manner in which a supply part is disposed.

FIG. 13 is a top view of the image forming apparatus 1 in which the exterior cover 71 is not shown. As described above, the operation unit 201 forms the supply opening 204. The operation unit 201 includes the ring part 201*a* formed so as to surround the supply opening 204, and the lever part 201*b* connected to the ring part 201*a*. As shown in FIG. 13, the width of the supply part 200 in the X-direction is smaller than the width of the accommodation unit 18 in the X-direction.

The laser beam emitted from the scanner unit 50 to irradiate the photosensitive drum 11 is spread into a trapezoidal shape as shown in FIG. 13 by a polygon mirror (not shown) and a lens (not shown). The width of the scanner unit 50 is smaller than the width of the photosensitive drum 11 in the X-direction. As a result, a space occurs between the left end of the scanner unit 50 and the left side plate frame 74. In the present embodiment, the supply part 200 is disposed in the space described above.

That is, as shown in FIG. 13, the supply part 200 is disposed, in the X-direction, between the scanner unit 50 and the left side plate frame 74. Furthermore, in the X-direction, the supply opening 204 and the scanner unit 50 are disposed side by side within a range corresponding to the region where the accommodation unit 18 is disposed. By providing the supply part 200 at the above-described location, it is possible to reduce the influence on the size of the image forming apparatus 1.

The location of the supply part 200 is opposite, via the scanner unit 50, to the location of the driving motor 311. The driving motor 311 employed in the present embodiment is relatively small, and thus there is no overlap in the Z-direction between the supply part 200 and the driving motor 311 as shown in FIG. 12. Therefore, it is possible to dispose the supply part 200 and driving motor 311 at the same locations with respect to the scanner unit 50. However, in a case where a greater driving motor is employed as the driving motor 311, it is necessary to shift the supply part 200 to an upper location.

This results in an increase in the size of the image forming apparatus 1. By disposing the supply part 200 and the scanner unit 50 at opposite locations as described above according to the present embodiment, it becomes possible to employ even the driving motor 311 of a greater size without causing an increase in the size of the image forming apparatus 1. In other words, it is possible to achieve an increased degree of freedom in design.

Supply Pack

Figure 14A:
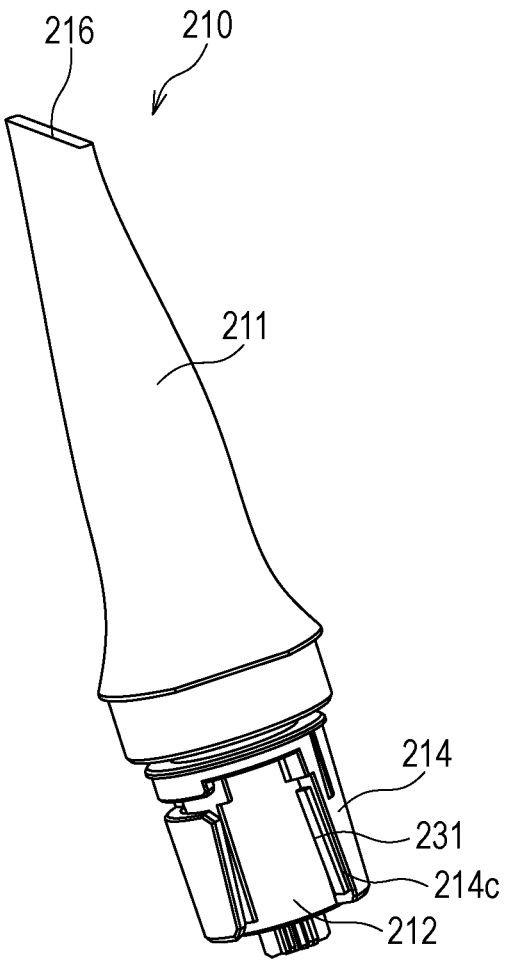
FIGS. 14A and 14B are perspective views each illustrating a supply pack with a shutter in a closed state.
Figure 14B:
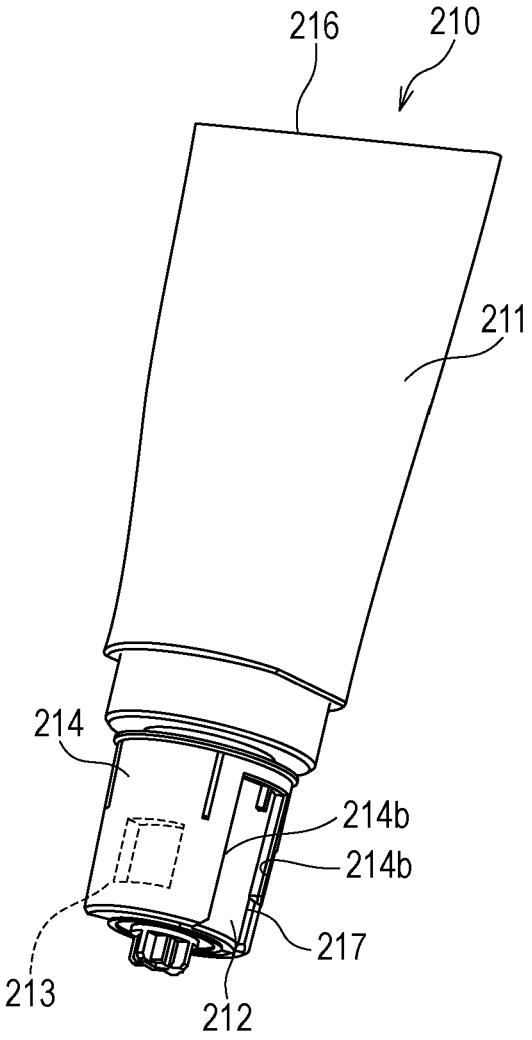
Figure 15A:
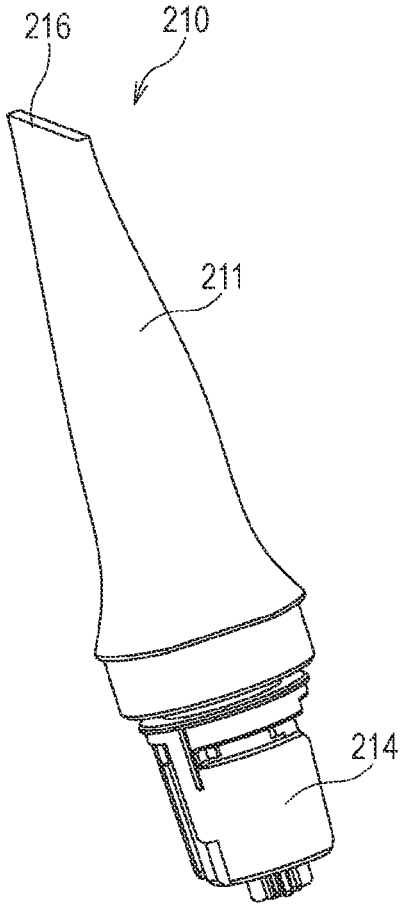
FIGS. 15A and 15B are perspective views each illustrating a supply pack with a shutter in an open state.
Figure 15B:
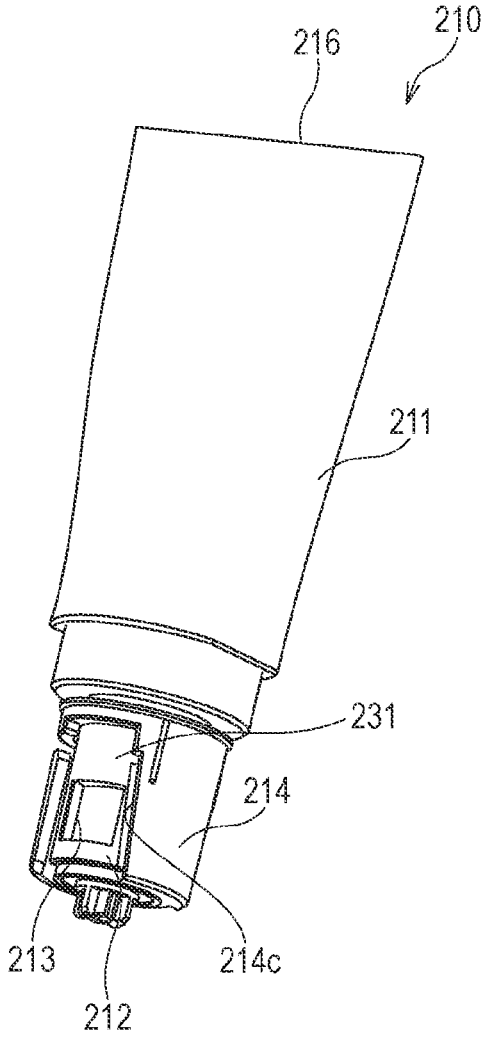
Figure 16A:
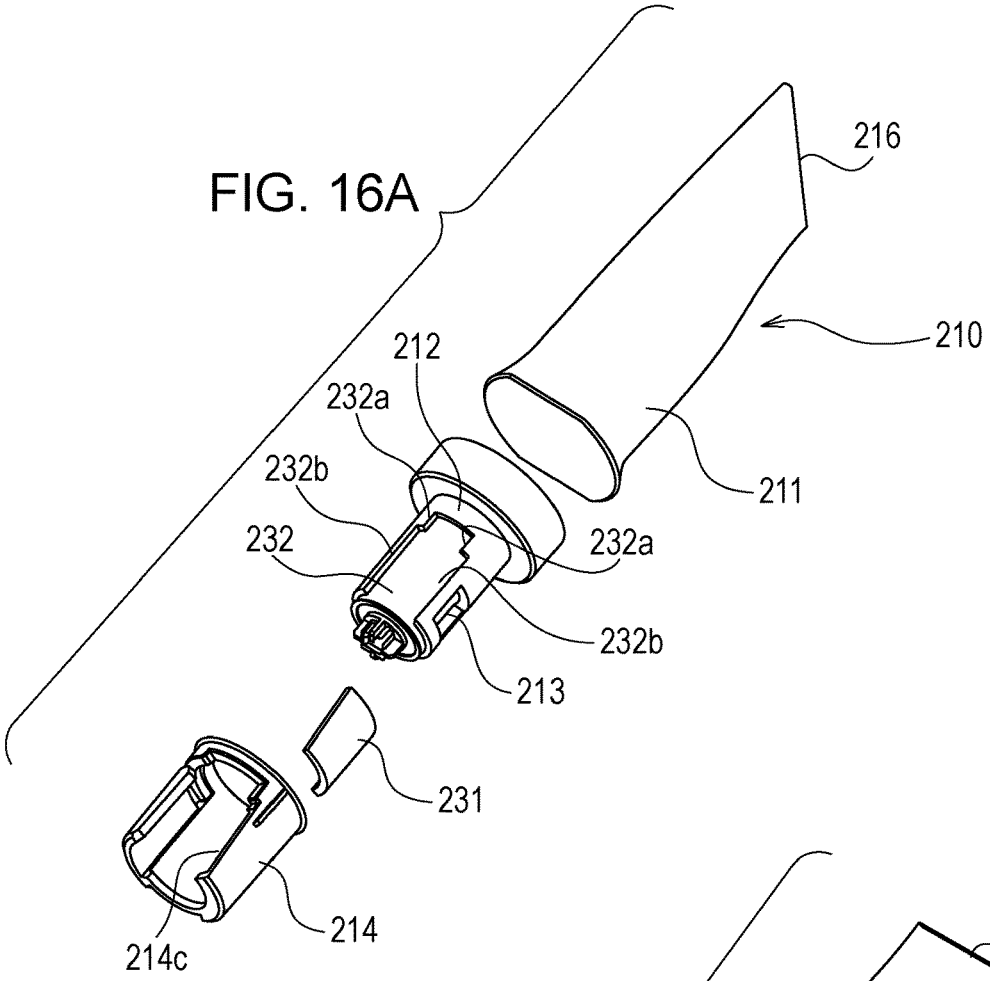
FIGS. 16A and 16B are exploded perspective views each illustrating a supply pack.
Figure 16B:
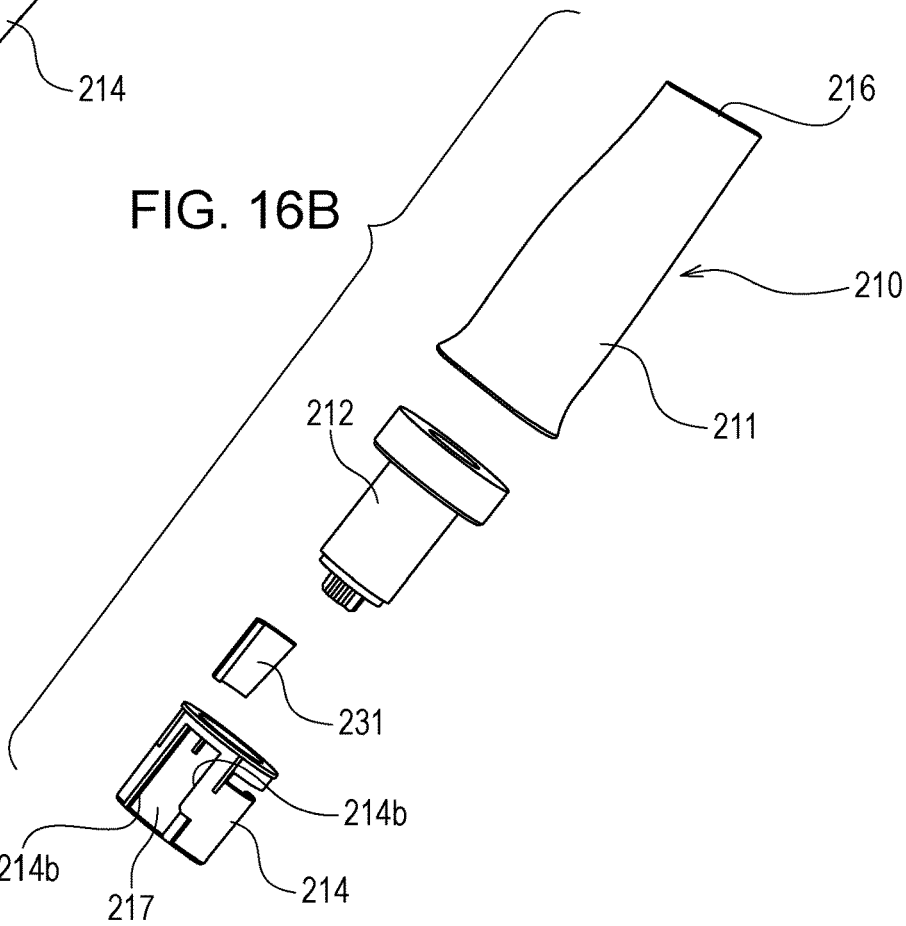

Next, with reference to FIGS. 14A and 14B to FIGS. 16A and 16B, a configuration of the supply pack 210 is described. FIGS. 14A and 14B are perspective views showing the supply pack in a state in which the pack shutter part 214 is in the closed position. FIGS. 15A and 15B are perspective views showing the supply pack in a state in which the pack shutter part 214 is in the open position. FIGS. 16A and 16B are exploded perspective views showing the supply pack.

The supply pack 210 as a toner container has a pouch part 211 functioning as a bag containing toner to be supplied, a cylindrical insertion part 212 to be inserted into the supply opening 204, and a pack shutter part 214 functioning as a container shutter. The insertion part 212 as a nozzle communicates with the pouch part 211.

The insertion part 212 has an opening 213 through which the toner in the pouch part 211 is discharged to the outside. The pouch part 211 is formed by a bag made of easily deformable plastic. However, this is merely an example, and the pouch part 211 is not limited to example. For example, the pouch part 211 may be realized by a resin bottle container, or a paper or vinyl container.

A pouch end part 216 is formed at the end part, of the pouch part 211, opposite to the insertion part 212. The pouch part 211 has a flattened shape which is more flattened toward the pouch end part 216, and the pouch end part 216 extends in a radial direction perpendicular to the rotation axis direction of the pack shutter part 214.

The pack shutter part 214 is a cylindrical member that is concentric with the insertion part 212 and is provided radially outward of the insertion part 212. The pack shutter part 214 has an opening 214*c*. The pack shutter part 214 can rotate with respect to insertion part 212 to a closed position where the opening 213 of the insertion part 212 is closed by the pack shutter part 214 and to an open position where the opening 213 is opened. When the opening 214*c* of the pack shutter part 214 overlaps the opening 213 of the insertion part 212, toner can be supplied from the supply pack 210 to the supply part 200.

A seal member 231 is fixed to the inner circumferential surface of the pack shutter part 214 such that the seal member 231 is slidable over the outer circumferential surface of the insertion part 212. When the pack shutter part 214 is in the closed position, the seal member 231 covers the opening 213 of the insertion part 212.

As shown in FIG. 16A, the insertion part 212 has a guide receiving part 232 recessed from the outer circumferential surface of the insertion part 212. The guide receiving part 232 includes a pair of first guide receiving parts 232*a* and a pair of second guide receiving parts 232*b*. When the supply pack 210 is attached to the supply part 200, the guide parts 247 and 248 integrally formed with the toner receiving part 202 fit into the guide receiving part 232. As a result, relative movement is restricted between the insertion part 212 and the toner receiving part 202 in the circumferential direction about the rotation axis of the pack shutter part 214.

Furthermore, as shown in FIG. 16B, on the outer circumferential surface of the pack shutter part 214, there are formed a positioning part 217 configured to engage with the operation unit 201 and drive transmission surfaces 214*b* facing each other via the positioning part 217 in the circumferential direction of the outer circumference of the pack shutter part 214. That is, on the outer circumferential surface of the pack shutter part 214, a groove part (a recess which is recessed inward in the radial direction of the pack shutter part 214) is formed such that the groove bottom surface (the bottom surface of the recess) is given by the positioning part 217, and the groove side walls are given by the drive transmission surfaces 214*b*.

The groove part described above is open at the end, of the outer circumferential surface of the pack shutter part 214, in the insertion direction of the insertion part 212. When the drive transmission surfaces 214*b* receive a force in the circumferential direction from the operation unit drive transmission protrusion 201*d* of the operation unit 201, the pack shutter part 214 rotates about insertion part 212.

When the pack shutter part 214 is in the closed position, the insertion part 212 comes into a state in which the opening 214*c* formed in the pack shutter part 214 and the guide receiving part 232 formed so as to be recessed from the outer circumferential surface of the insertion part 212 overlap each other in the rotation phase in the circumferential direction.

In this state, the guide parts 247 and 248 of the supply part 200 are inserted into the guide receiving parts 232 of the supply pack 210 and the opening 214*c* is fitted to the peripheral edge of the seal member 243 provided on the inner circumferential surface of the main body shutter part 206. When the supply pack 210 is attached to the supply part 200, the first guide receiving part 232*a*, which is one of the guide receiving parts 232 that are located on the upstream side, engages with the guide part 247, while the second guide receiving part 232*b*, which is one located on the downstream side, faces the guide part 248.

A circumferentially extending surface, which forms a step between the first guide receiving part 232*a* and the second guide receiving part 232*b*, engages in the insertion direction with a circumferentially extending surface that forms a step between the guide part 247 and the guide part 248 thereby determining the position in the insertion direction between the insertion part 212 and the operation unit 201. The opening 214*c* has a notched shape that widens toward the end of the insertion part 212. The seal member 243 comes into a state in which it is located between a pair of facing parts which form the opening 214*c* and face each other in the circumferential direction.

The drive transmission surface 214*b* of the pack shutter part 214 engages with the operation unit drive transmission protrusion 201*d* of the operation unit 201 and also with the main body shutter drive transmission protrusion 206*a* of the main body shutter part 206. When an operation force is applied to the operation unit 201, the operation force causes the pack shutter part 214 to move (rotate), and the operation force is transmitted to main body shutter part 206, which causes the main body shutter part 206 to also move. That is, the drive transmission surface 214*b* has an area which functions as a force receiving area and contacts and engages with the operation unit drive transmission protrusion 201*d*. The operation unit drive transmission protrusion 201*d* has a shape protruding radially inward from the inner circumferential surface of the operation unit 201, and the drive transmission surface 214*b* has an area which functions as a force application area and contacts and engages with the main body shutter drive transmission protrusion 206*a*.

Structure of Rear Cover and Transfer Unit

Figure 17A:
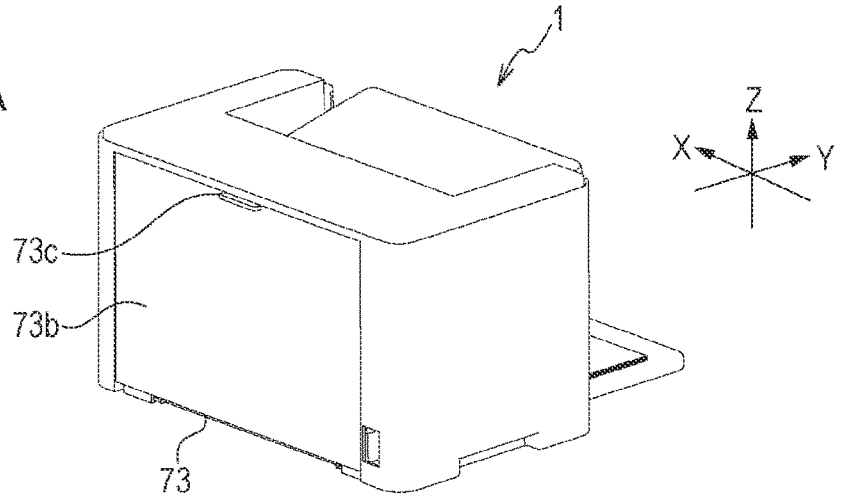
FIGS. 17A, 17B, and 17C are perspective views illustrating an operation of opening/closing a rear cover and a transfer unit.
Figure 17B:
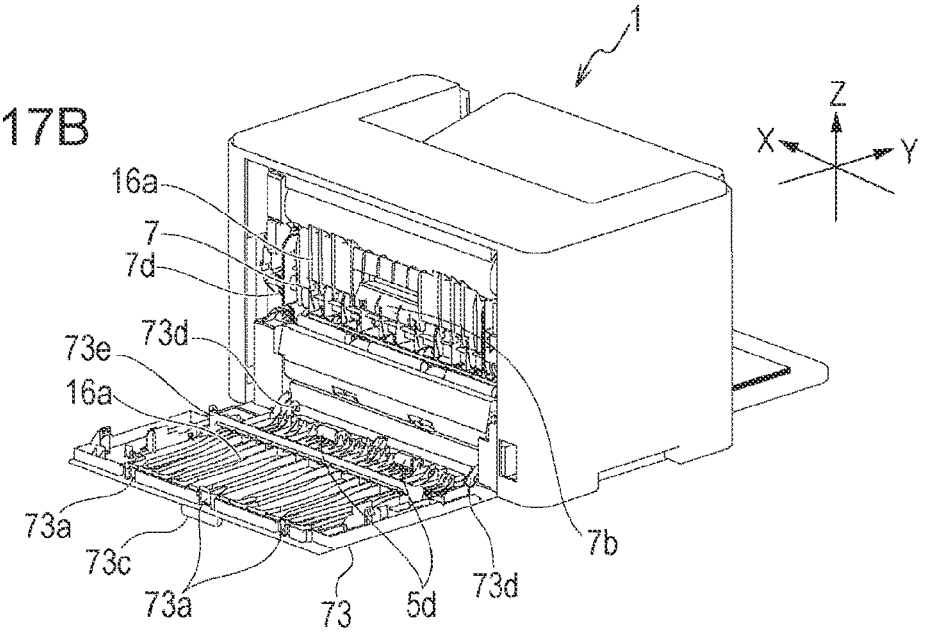
Figure 17C:
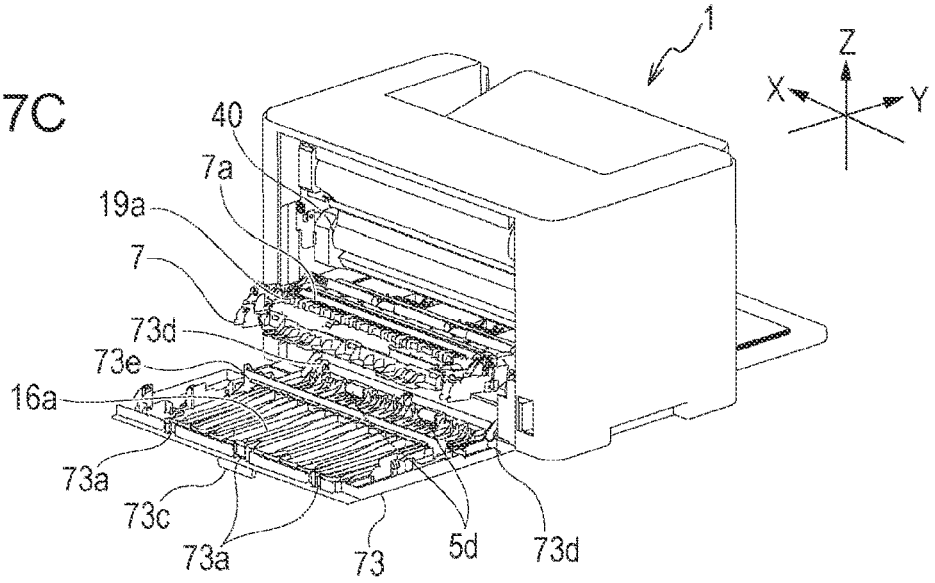

As shown in FIGS. 17A to 17C and FIGS. 18A to 18D, on the rear side of the image forming apparatus 1, a rear cover 73 is provided such that the rear cover 73 is rotatable about the cover engaging part 73*d* between open and closed positions of the image forming apparatus 1. FIGS. 17A to 17C are perspective views showing opening/closing operation of the rear cover 73 and the transfer unit 7. FIGS. 18A to 18D are each a cross-sectional view showing the vicinity of the conveying path seen from the side.

Figure 18B:
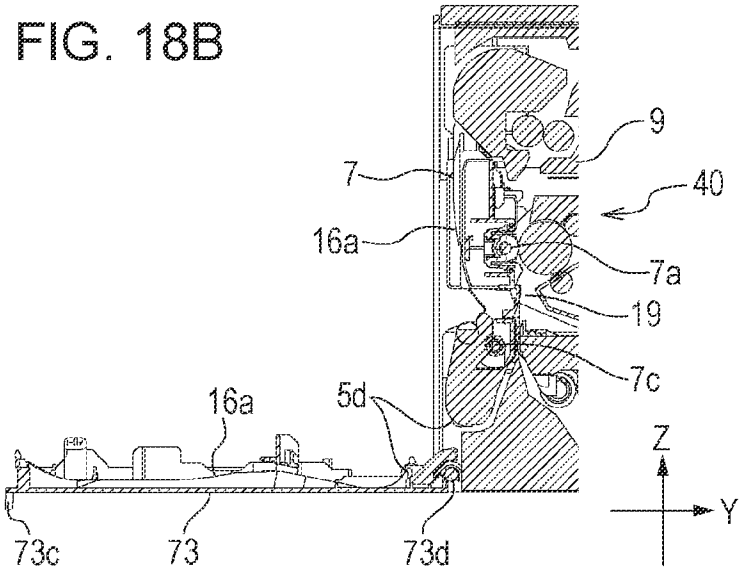
FIGS. 18A, 18B, 18C, and 18D are cross-sectional views illustrating an operation of opening/closing a rear cover and a transfer unit, and a relationship with a conveying path.
Figure 18D:
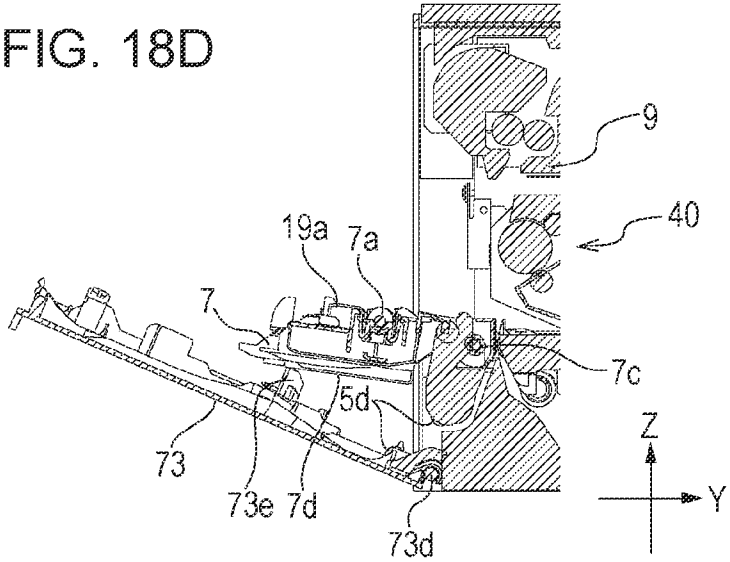
Figure 18A:
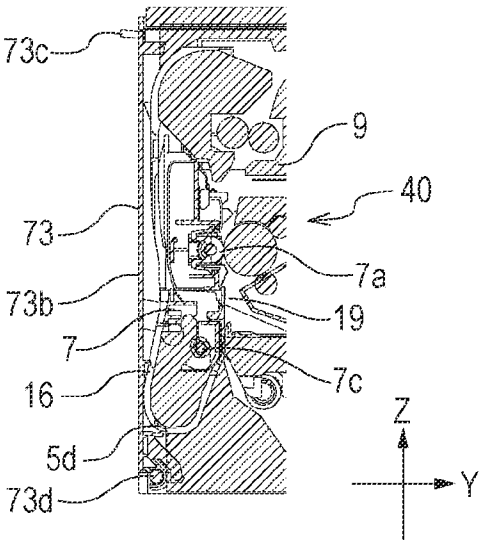

When the rear cover 73 is in the closed position, the rear cover 73 covers the transfer unit 7 and the process unit 40 as shown in FIG. 17A and FIG. 18A. When the rear cover 73 is opened together with the transfer unit 7 which also functions as the opening and closing part forming the sheet conveying path, the process unit 40 is exposed. When the rear cover 73 is in the closed position, an engagement claw 73*a* of the rear cover 73 is engaged with the exterior cover 71, and the transfer unit 7 is urged toward the inside of the main body by a link member (not shown), and is maintained in the closed state until it is operated by a user.

As shown in FIG. 17B and FIG. 18B, when the rear cover 73 is opened, the double-sided conveying path 16, through which the sheet P passes while being conveyed by the double-sided conveying roller pair 5*d*, is opened. That is, the rear cover 73 is movable between the closed position where the double-sided conveying path 16 is covered and the open position where the double-sided conveying path 16 is exposed. In the double-sided conveying path 16, a plurality of paper guide ribs 16*a* are disposed inside the rear cover 73 and outside the transfer unit 7.

The outer side surface 73*b* of the rear cover 73, that is, the surface forming the exterior surface of the housing 72 has a grip part 73*c* that can be gripped by a user to open or close rear cover 73. The pressure roller 9*b* of the fixing unit separates from or contacts the heating film 9*a* in response, via a link (not shown), to the opening or closing movement of the rear cover. Therefore, when the double-sided conveying path 16 is exposed, the pressure roller 9*b* of the fixing unit is in the separated state, and there is no contact pressure applied to heating film 9*a* by the pressure roller 9*b*.

Figure 18C:
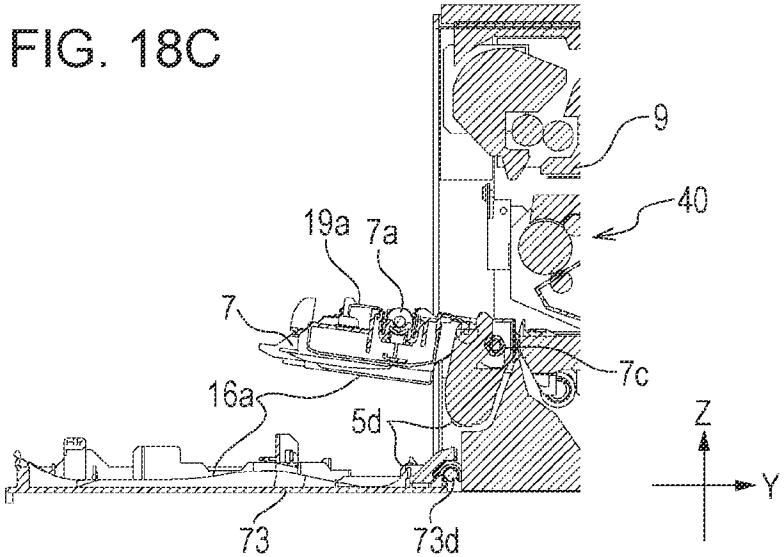

As shown in FIG. 17C and FIG. 18C, when the transfer unit 7 is opened, the conveying path 19 is opened over the registration roller, the transfer unit, and the fixing unit through which the sheet P is passed while being conveyed by the conveying roller pair 5*c*. That is, the transfer unit 7 can rotate about the transfer unit engaging part 7*c* shown in FIG. 18C, and thus can move between the closed position in which the conveying path 19 is covered and the open position in which the conveying path 19 is exposed. The state in which the transfer unit 7 is in the closed position is referred to as the closed state, while the state in which the transfer unit 7 is in the open position is referred to as the open state.

When the transfer unit 7 is in the closed state, the transfer roller 7*a* is in contact with the photosensitive drum 11, and a nip is formed. The paper guide ribs 19*a* are disposed in the transfer unit 7 so as to form the conveying path 19. As shown in FIG. 17B, the transfer unit 7 has a grip part 7*b* formed on a part of a surface forming the double-sided conveying path 16 such that a user is allowed to grip the grip part 7*b* to open or close the transfer unit 7.

Door Open/Close Operation to Handle Jam

Referring to FIGS. 17A to 17C and FIGS. 18A to 18D, a method of removing a jammed sheet P from the image forming apparatus is described. When a jam occurs, a user may first open the rear cover 73 such that the image forming apparatus gets into the state shown in FIG. 17B and FIG. 18B. In this state, the user can access the double-sided conveying path 16 in the main body of the image forming apparatus and can remove the jammed sheet P in a case where the jam occurs near the double-sided conveying path 16.

In a case where the jam has occurred near the transfer unit, the use may further open the transfer unit 7 in the state in which the rear cover 73 is in the open state as shown in FIG. 17C and FIG. 18C and may access the conveying path 19 and remove the sheet P. Thus, when a jam occurs, it is possible to handle the jam simply by opening the rear cover 73 and the transfer unit 7 without detaching and attaching the process unit 40.

After the user finishes the jam handling, it is necessary to close the rear cover 73 and the transfer unit 7 to achieve the state in which it is allowed to perform an image forming process. In the present embodiment, the transfer unit 7 is automatically closed in response to the operation of closing the rear cover 73.

Referring to FIG. 18D, the operation of closing the rear cover 73 and the transfer unit 7 is described. When the rear cover 73 is closed, only the rear cover 73 rotates up to a certain angle due to a difference in the rotation center. When a pressing rib 73*e* of the rear cover 73 comes into contact with a pressed part 7*d* of the transfer unit 7, and the transfer unit 7 is also closed together. It is also allowed for the user to first close the transfer unit 7 and then close the rear cover 73.

Detachment and Maintenance of Process Unit 40

In the present embodiment, attachment/detachment and maintenance of the process unit 40 by a service person or the like can be easily performed by opening the rear cover 73 and the transfer unit 7 in the same manner as when jamming is handled.

A method of removing the process unit 40 is described below referring to FIGS. 19A to 19D and FIGS. 20A to 20D showing parts related to the detachment/attachment of the process unit 40. FIGS. 19A to 19D are perspective views showing a manner of detaching/attaching the process unit 40, FIGS. 20A to 20D are cross-sectional views showing the manner of detaching/attaching the process unit 40.

Figure 19A:
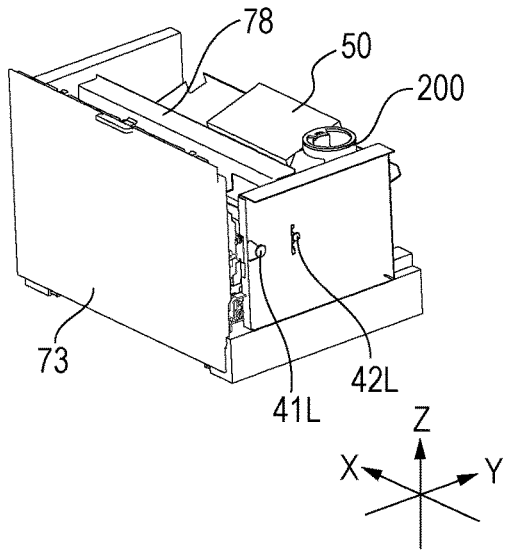
FIGS. 19A, 19B, 19C, and 19D are perspective views illustrating a method of attaching and detaching a process unit.
Figure 19B:
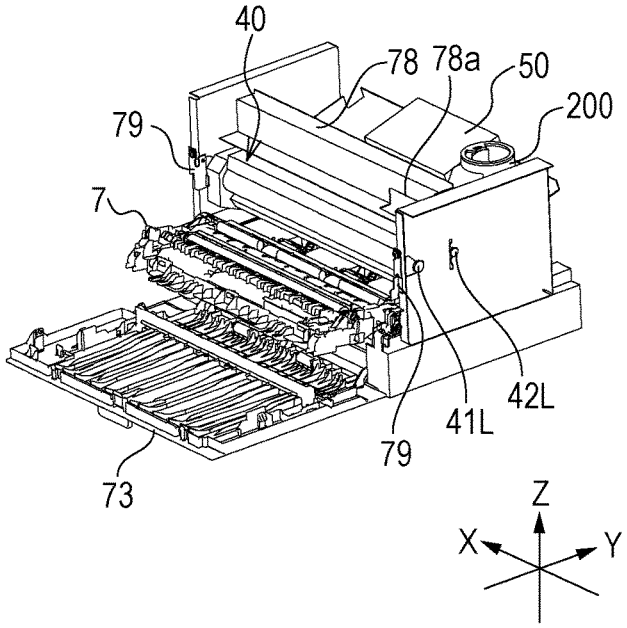
Figure 19C:
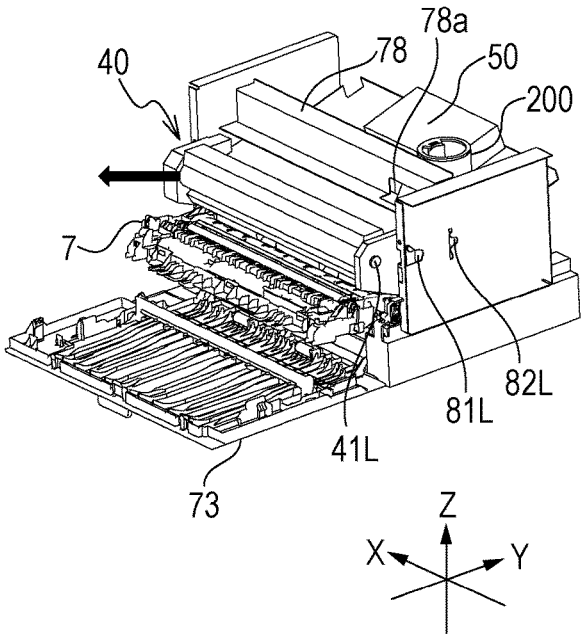
Figure 20B:
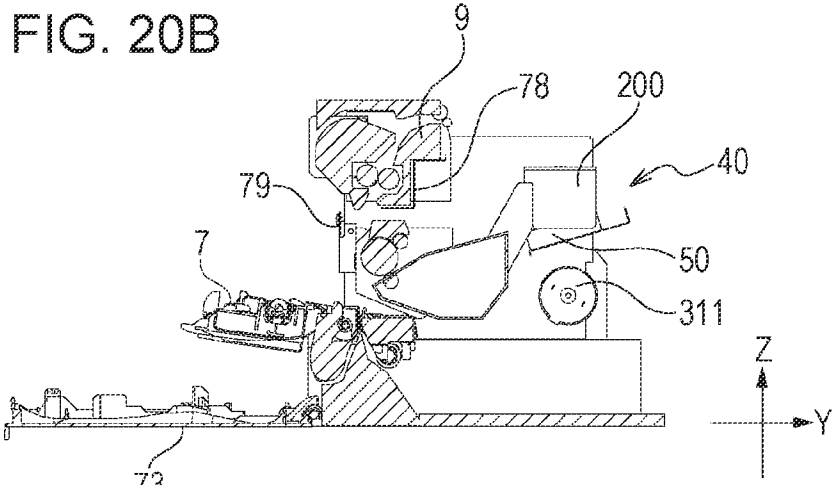
FIGS. 20A, 20B, 20C, and 20D are cross-sectional views illustrating a method of attaching and detaching a process unit.
Figure 20A:
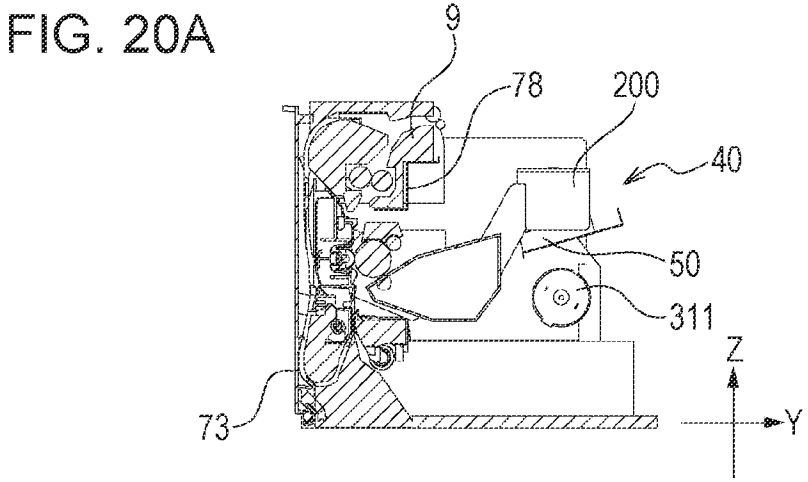

In FIG. 19A and FIG. 20A, the rear cover 73 is in the closed state. First, when the rear cover 73 and the transfer unit 7 are opened, the process unit 40 is exposed as shown in FIG. 19B and FIG. 20B. The process unit 40 is fixed to the main body of the apparatus by left and right fixing members 79. In the present embodiment, the fixing members 79 made of sheet metal are fastened with screws to fix the process unit 40, but the fixing method is not limited to this. For example, an urging member such as a spring or the like may be used, or the process unit 40 may be fixed by an urging force given by the transfer roller 7*a*.

The left and right positioning bosses 41L and 41R and the rotation restriction bosses 42L and 42R of the process unit 40 are engaged with the positioning parts 81L and 81R and the rotation restriction parts 82L and 82R of the left and right side plates, and thus, in conjunction with the fixing member 79, the process unit 40 is fixed in the predetermined position.

Furthermore, an engaging part (not shown) is also engaged with the process unit 40 to transmit the driving force from the driving motor 311 to the photosensitive drum 11. Therefore, to remove the process unit 40, it is necessary to disengage the fixing member 79 and separate the driving force transmission engaging parts, and then move the process unit 40 in the direction indicated by an arrow shown in FIGS. 19C and 20C thereby releasing the engagement between the process unit 40 and the positioning part of the left and right side plates.

Figure 19D:
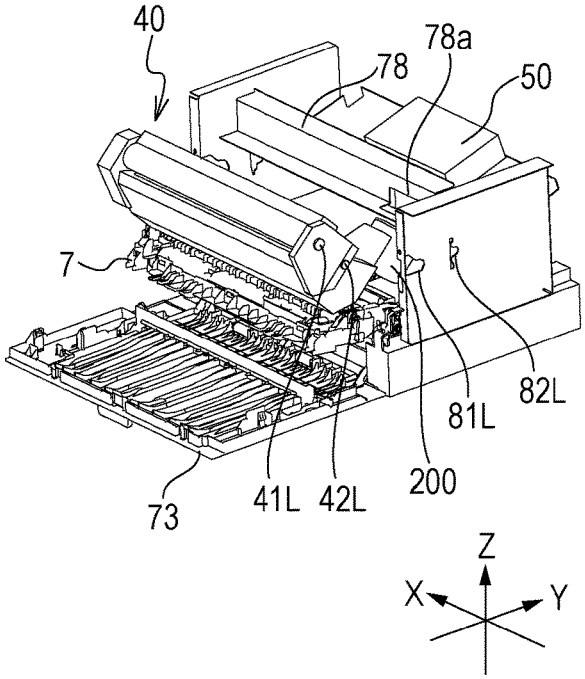
Figure 20D:
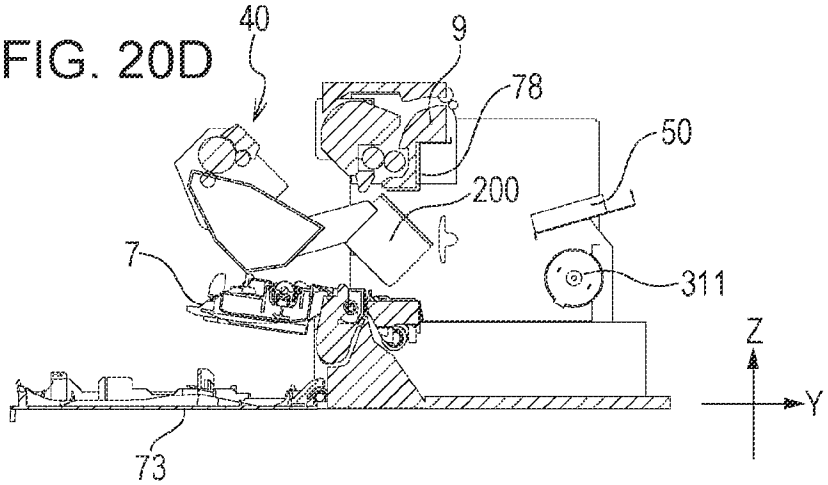
Figure 20C:
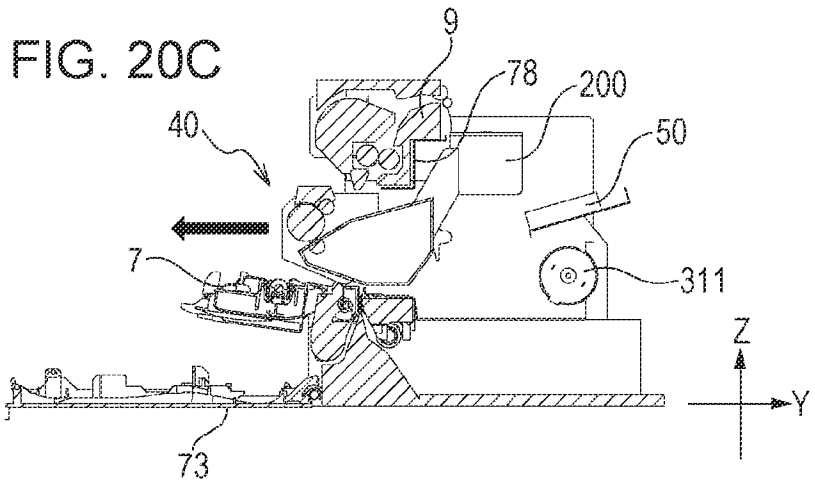

In the configuration according to the present embodiment, to reduce the size of the image forming apparatus 1, the supply part 200, which is a part of the process unit 40, overlaps the fixing unit 9 in the Z- and X-directions. Therefore, as shown in FIGS. 19D and 20D, the process unit 40 is moved while rotating it about the X-axis such that the supply part 200 does not get into contact with the fixing unit 9 in the middle of the removing movement.

Furthermore, a notch 78*a* is formed in a fixing stay 78 that holds the fixing unit 9 such that the supply part 200 does not get into contact with the process unit 40 in the middle of the process of removing the process unit 40. However, the present embodiment is not limited to this example. For example, the process unit 40 and the fixing unit 9 may not overlap in the Z-direction, and the process unit 40 may be removed via a linear movement path.

To attach the process unit 40, the above-described procedure of removing the process unit 40 is reversely performed. As described above, in the present embodiment, the image forming apparatus 1 is of the toner replenishment type and is configured such that the process unit 40 is attached/detached via the same opening and closing part on the back side for both jam handling and maintenance, thereby achieving the improvement in the usability and the reduction in the size of the main body of the image forming apparatus 1.

Configuration of Link for Rotating Transfer Unit

Figure 21:
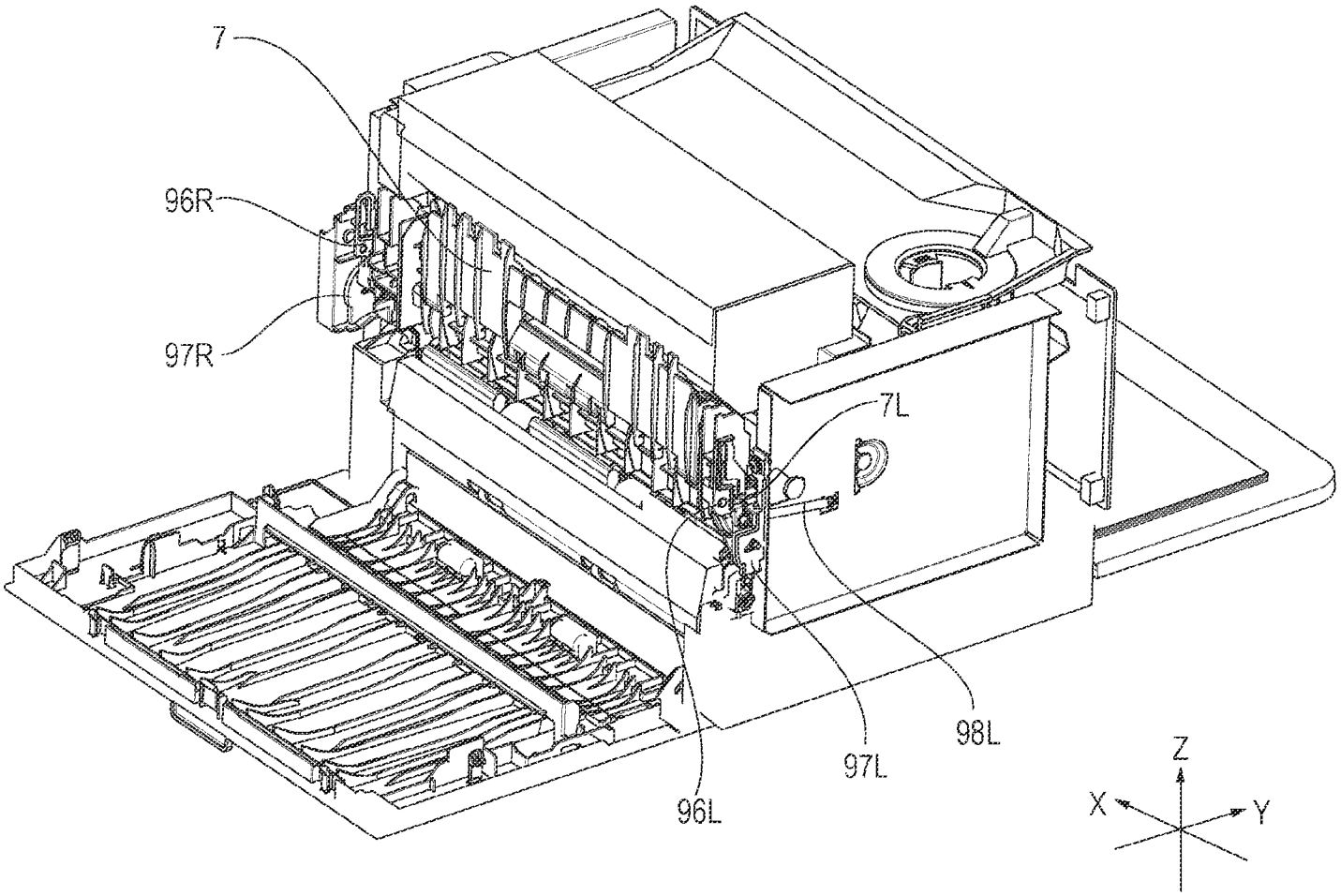
FIG. 21 a perspective view illustrating a transfer unit and a link that rotates the transfer unit in a closed direction.

The link part 96L and the link part 96R configured to allow the transfer unit 7 to rotate in the closing direction are described in detail below. FIG. 21 shows a state of the link part 96L and the link part 96R after the transfer unit 7 is rotated to the closed state. The link part 96L and the link part 96R are provided substantially symmetrically in the transfer unit 7. The link part 96L and link part 96R are urged by tension springs, including a tension spring 98L, functioning as urging members such that the transfer unit 7 is pressed in the closing direction. In other words, the tension springs urges the transfer unit 7 to the closed state.

In the configuration according to the present embodiment, the transfer unit 7 having the transfer roller 7*a* is urged by the tension spring 98 toward the main body of the apparatus. The transfer unit 7 receives the nip pressure between the photosensitive drum 11 and the transfer roller 7*a*, and thus if the urging force of the tension spring 98 is weak, the transfer unit 7 is opened, which affects image formation. Therefore, the urging force of the tension spring 98 has to be large enough.

In the present embodiment, it is assumed by way of example that the transfer unit 7 includes the transfer roller 7*a* and functions as the opening and closing part. Even when the transfer roller is not provided, it is necessary to strongly urge the opening and closing part which forms a recording medium conveying path such that the opening and closing part forming the conveying path of the recording medium is prevented from being opened by the pressure from the recording medium.

The link part 96L and the link part 96R are rotatably held respectively by a link holder 97L and a link holder 97R fixed to the main body. The link part 96L and the link part 96R are the same in structure, and thus the link part 96L will be mainly described in the following description.

Figure 22A:
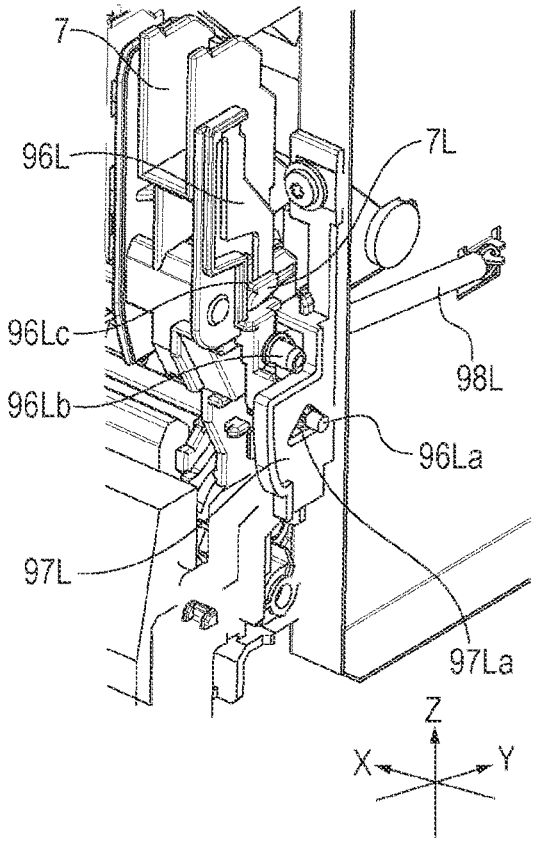
FIGS. 22A, 22B, 22C, and 22D are enlarged diagrams illustrating a transfer unit, a link, a link holder, and a tension spring, in a state in which the transfer unit is closed.
Figure 22B:
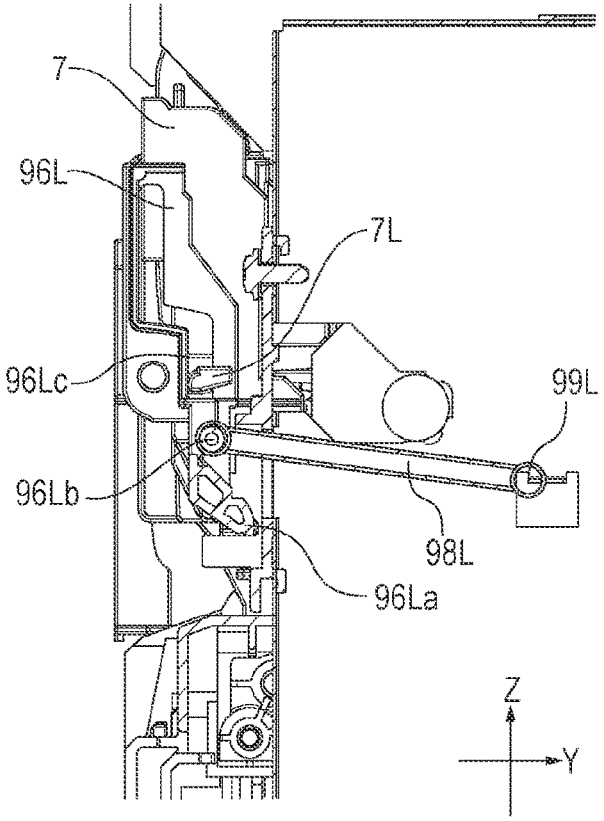
Figure 22C:
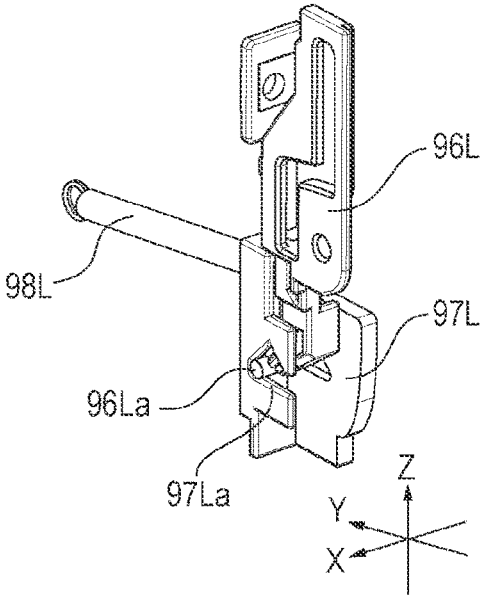
Figure 22D:
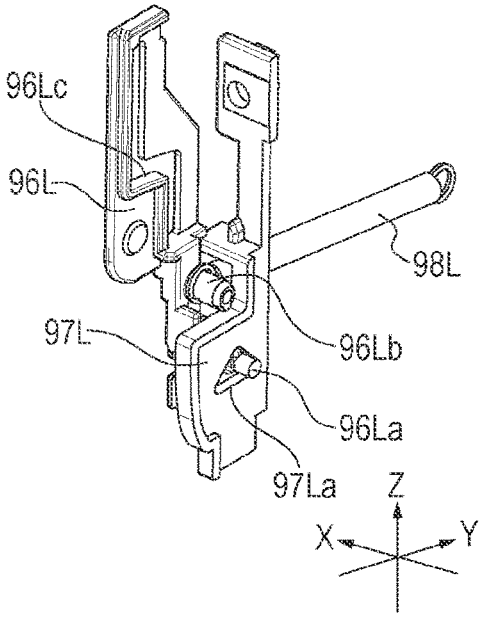

The details of the link part 96L are described below with reference to FIG. 22A showing an enlarged view of the link part 96L shown in FIG. 21, FIG. 22B showing a cross-sectional view near the tension spring 98L, and FIGS. 22C and 22D showing only the link part 96L, the link holder 97L, and the tension spring 98L, which are seen obliquely from the rear side of the main body of the image forming apparatus.

A rotation center part 96La which is a second part of the link part 96L is held by the link holder 97L fixed to the main body of the apparatus. One of the tension springs 98L urges the link shaft 96Lb in the Y-direction. The other one of the tension springs 98L is supported by a supporting part 99L of the main body of the apparatus.

The link part 96L rotates about the rotation center part 96La with respect to the main body of the apparatus. A holding hole (a receiving hole) 97La, which is a first part of the main body of the apparatus and engages a link rotation center part 96La, holds the link rotation center part 96La such that the link rotation center part 96La is movable in a direction perpendicular to the direction along the rotating shaft of the link rotation center part 96La (in a direction parallel to a page of FIG. 22B). More specifically, in the present embodiment, the hole size of the holding hole 97La is greater than the diameter of the link rotation center part 96La and thus the link rotation center part 96La is movable in the holding hole 97La.

That is, in a state in which the link part 96 is connected to the transfer unit 7 and the main body of the apparatus, the link part 96 is movable with respect to the transfer unit 7 and the main body of the apparatus. In the present embodiment, the second part is a shaft member and the first part is the hole engaged with the shaft member, but the configuration is not limited to this example. For example, the second part may be a hole, and the first part may be a shaft member.

A link hole 96Lc formed in the link part 96L is engaged with the transfer shaft (protruding part) 7L. In this state, the link part 96L receives a force from the tension spring 98L and the link part 96L transmits the received force to the transfer unit 7 via the link hole 96Lc thereby causing the transfer unit 7 to be brought into a stable closed state. The link hole 96Lc is a hole formed in the link part 96. The transfer shaft 7L extends in the X-direction from the transfer unit 7 and has a retaining rib.

Figure 23A:
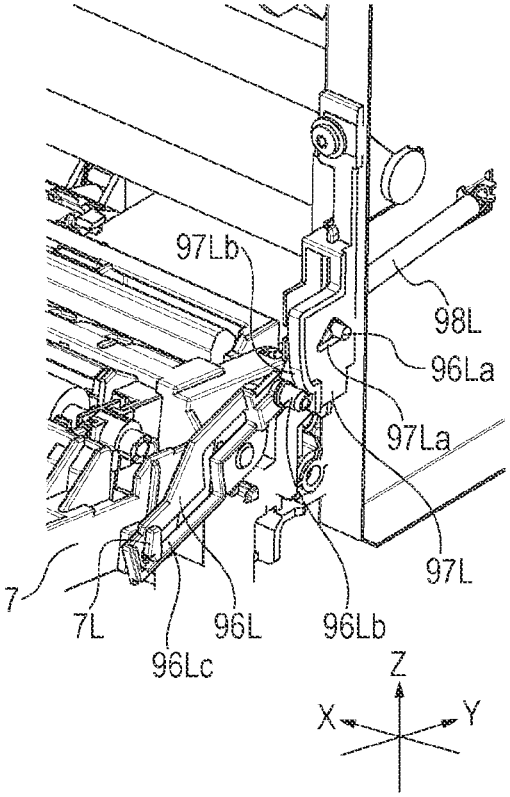
FIGS. 23A, 23B, 23C, and 23D are enlarged diagrams illustrating a transfer unit, a link, a link holder, and a tension spring, in a state in which the transfer unit is open.
Figure 23B:
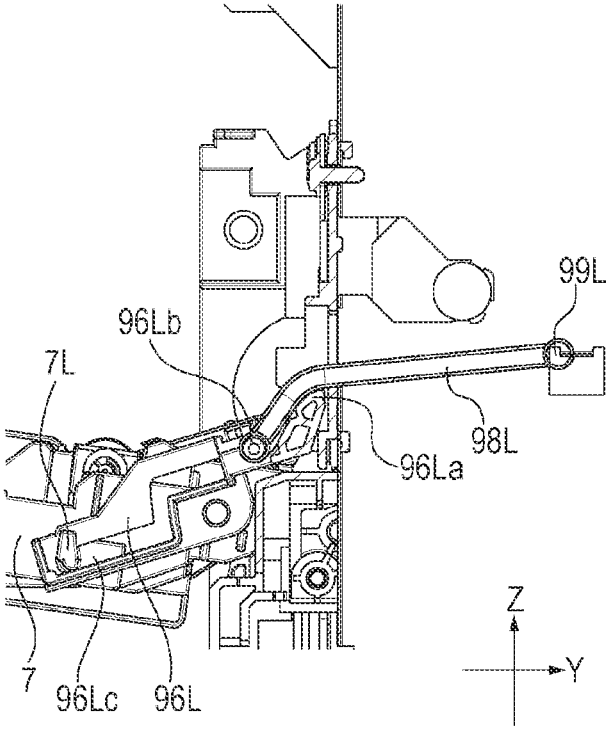
Figure 23C:
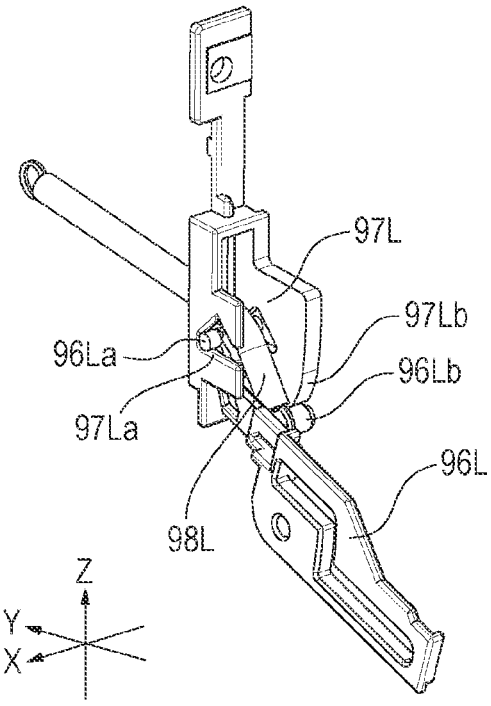
Figure 23D:
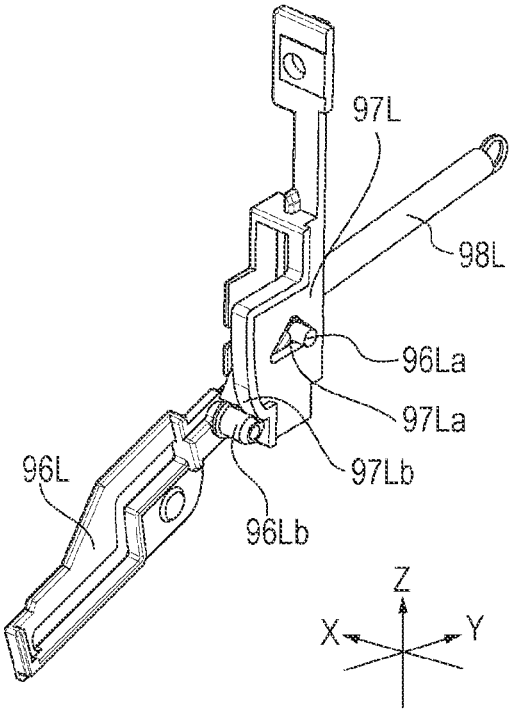

FIGS. 23A to 23D illustrate the transfer unit 7 and the link part 96L in a state in which the transfer unit 7 is in the open state. The link shaft 96Lb as a contact part is in contact with a link holder contact surface 97Lb (a receiving surface) formed on the link holder 97L, and the tension spring 98L is bent at the link rotation center part 96La as shown in FIG. 23B. In the configuration according to the present embodiment, the link part 96L is connected to the main body of the apparatus and the transfer unit 7 in all positions of the transfer unit 7 including the open position, the closed position, and any position between the open position and the closed position.

Figure 24A:
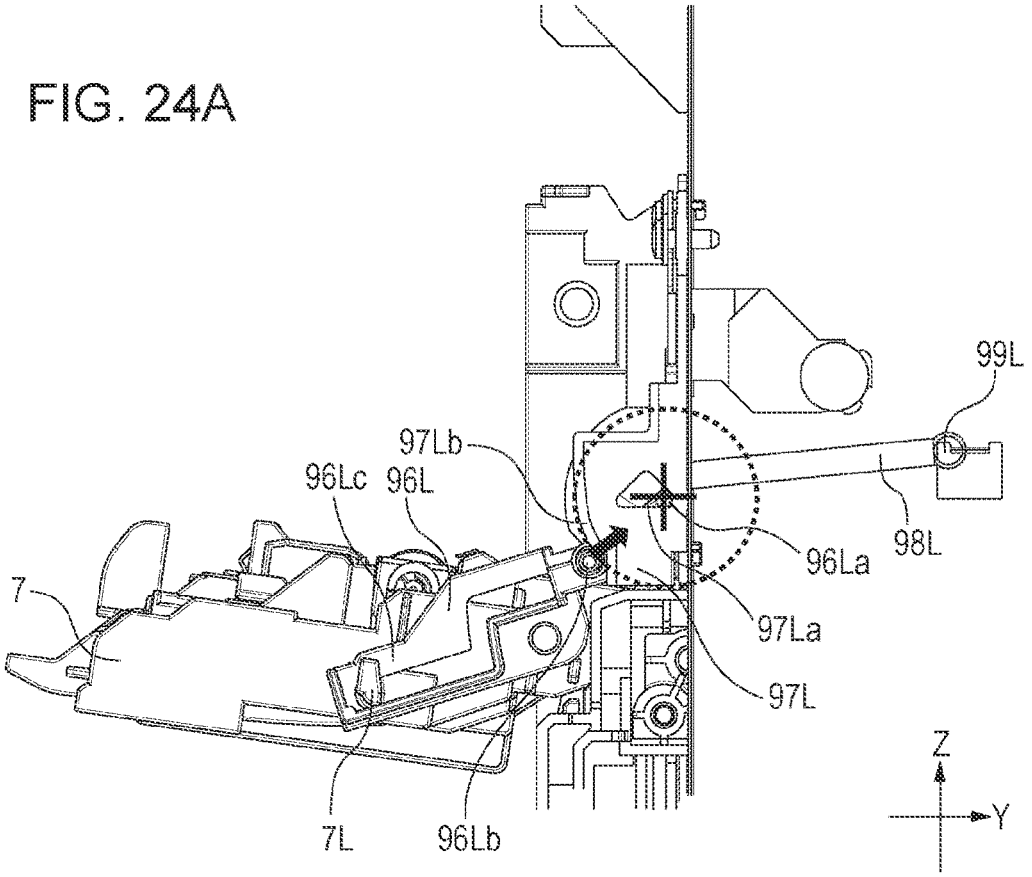
FIGS. 24A and 24B are cross-sectional views illustrating an operation of opening/closing a transfer unit.
Figure 24B:
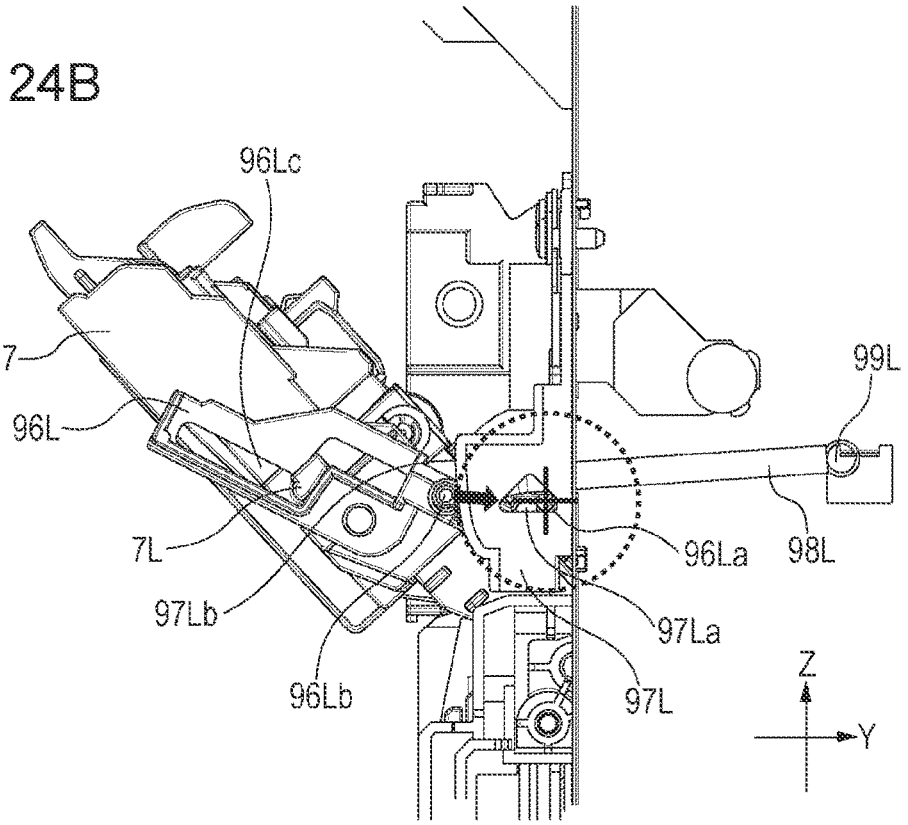

FIG. 24A and FIG. 24B illustrate a manner in which the transfer unit 7 is closed from the state shown in FIGS. 23A to 23D. When a user lifts the transfer unit 7, a moment is transmitted from the transfer shaft 7L to the link hole 96Lc and the link part 96L rotates until the state shown in FIG. 24B is reached. As a result, the link shaft 96Lb and the link holder contact surface 97Lb come into contact with each other, and the link holder contact surface 97Lb receives the urging force of the tension spring 98L from the link shaft 96Lb.

The lower side of the link holder contact surface 97Lb has an arc shape centered on the link rotation center part 96La when the transfer unit 7 is in the open state. The vector of the urging force applied to the link shaft 96Lb by the tension spring 98L points toward a location near the link rotation center part 96La (see FIG. 23B).

Therefore, in the states from FIG. 24A to FIG. 24B, the force of the tension spring 98L acts on the link holder contact surface 97Lb and thus the moment that tries to rotate the link part 96L in a direction toward the closing state is sufficiently reduced. Therefore, when the user closes the transfer unit 7, the transfer unit 7 is operated in a state in which the influence of the urging force of the tension spring 98L is reduced. Similarly, when the transfer unit 7 is opened from the state shown in FIG. 24B to the state shown in FIG. 24B, the transfer unit 7 is operated in a state in which the influence of the urging force of the tension spring 98L is reduced. Therefore, even if the urging force of the tension spring 98L is increased, deterioration of usability is suppressed.

That is, when the transfer unit 7 is in an intermediate position between the open position and the closed position, the link shaft 96Lb and the link holder contact surface 97Lb are in contact with each other. The link shaft 96Lb and the link holder contact surface 97Lb does not need to be always in contact with each other when the transfer unit 7 moves from the open position to the closed position. Note that the intermediate position may not be the middle position between the closed position and the open position of the transfer unit 7.

The holding hole 97La is larger than the link rotation center part 96La, and thus the link rotation center part 96La can move in the holding hole 97La. When the transfer unit 7 moves between the open position and the closed position, the link rotation center part 96La moves with respect to the holding hole 97La in a direction perpendicular to the rotation axis direction of the link rotation center part 96La, and the link shaft 96Lb and the link holder contact surface 97Lb come into contact with each other. In this state, the link rotation center part 96La urged by the tension spring 98L is received by the link holder contact surface 97Lb, and the transfer unit 7 can move in the state in which the link shaft 96Lb and the link holder contact surface 97Lb are in contact with each other. When the transfer unit 7 moves in the state in which the link shaft 96Lb and the link holder contact surface 97Lb are in contact with each other, the link shaft 96Lb moves along the link holder contact surface 97Lb while sliding on the link holder contact surface 97Lb.

When the transfer unit 7 is in an intermediate position between the open position and the closed position, the holding hole 97La and the link rotation center part 96La are slightly separated from each other. When the transfer unit 7 is in the open position or the closed position, the holding hole 97La and the link rotation center part 96La are in contact with each other.

Figure 25A:
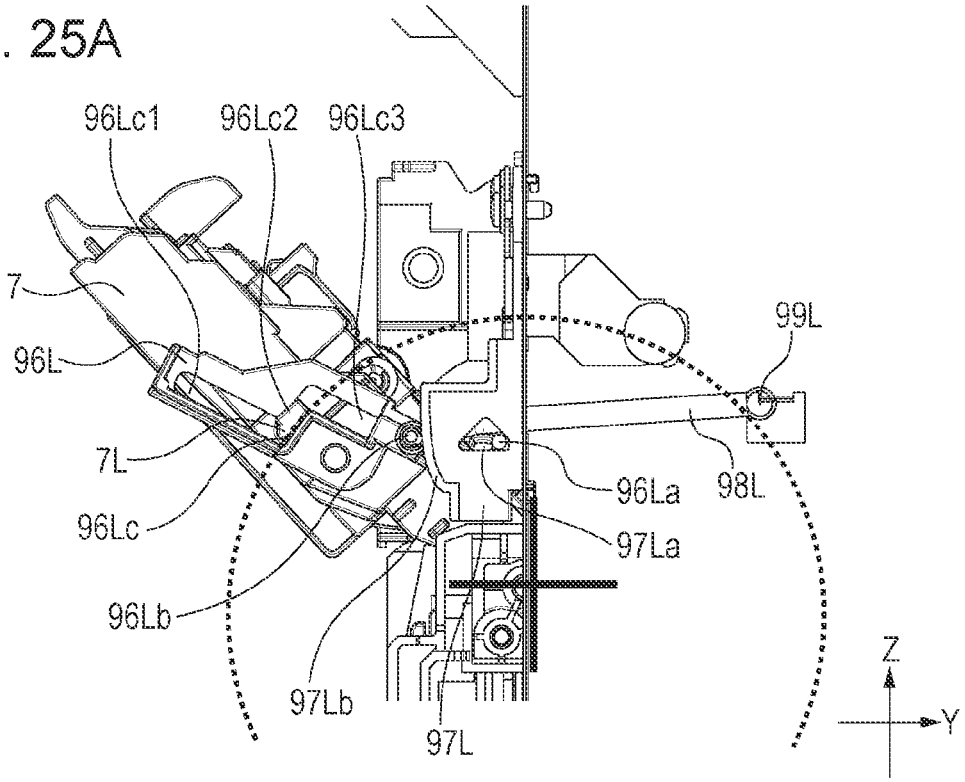
FIGS. 25A and 25B are cross-sectional views illustrating an operation of opening/closing a transfer unit (an operation of slightly closing the transfer unit from the state shown in FIGS. 24A and 24B).
Figure 25B:
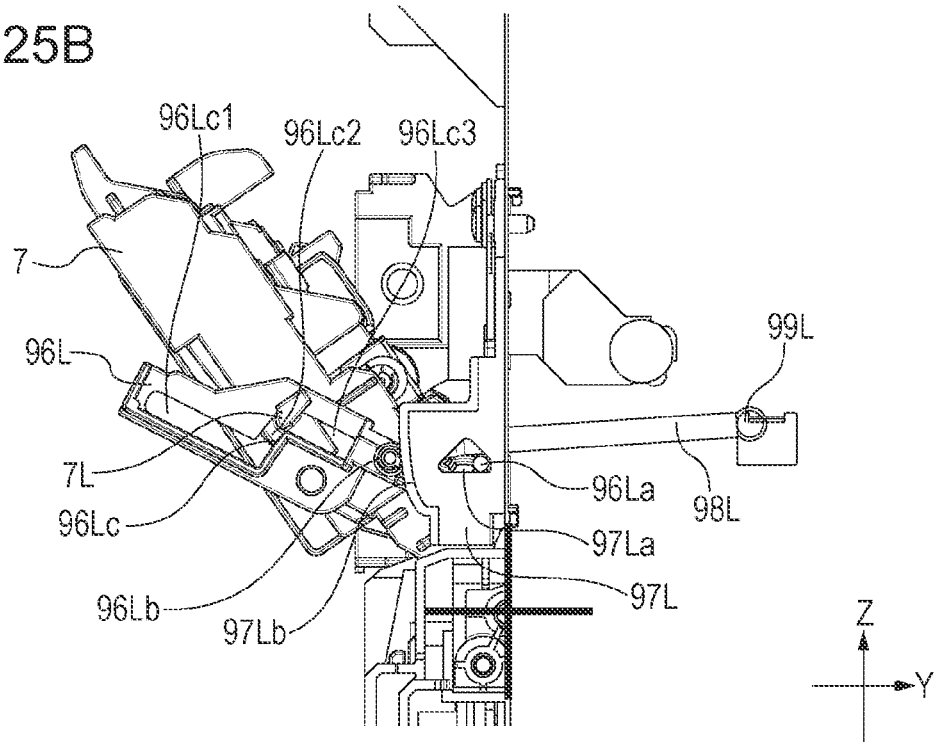

FIG. 25A and FIG. 25B illustrate a manner in which the transfer unit 7 in the state shown in FIG. 24B is closed.

The transfer shaft 7L is inserted in the link hole 96Lc. The link hole 96Lc with which the transfer shaft 7L is in contact has a first region 96Lc 1, a second region 96Lc2, and a third region 96Lc3. The second region 96Lc2 is located between the first region 96Lc1 and the third region 96Lc3, and extends in a direction crossing the first region 96Lc1 and the third region 96Lc3. That is, the first region 96Lc1 extends in a first direction, the second region 96Lc2 extends in a second direction, and the third region 96Lc3 extends in a third direction, where the second direction intersects the first direction and the third direction.

When the transfer unit 7 is in the open position, the transfer shaft 7L is positioned in the first region 96Lc 1, while when the transfer unit 7 is in the closed position, the transfer shaft 7L is positioned in the third region 96Lc3. When the transfer unit 7 moves from the closed position to the open position, the transfer shaft 7L moves from the third region 96Lc3 to the first region 96Lc1 via the second region 96Lc2. When the transfer unit 7 moves from the open position to the closed position, the transfer shaft 7L moves from the first region 96Lc1 to the third region 96Lc3 via the second region 96Lc2.

In the present embodiment, the second region 96Lc2 extends so as to form an arc shape centered on the rotation center part of the transfer unit 7. That is, the second direction is a direction along the arc centered on the rotation center part of the transfer unit 7. When the transfer unit 7 is rotated in the direction to the closing state from the state shown in FIG. 25A, the transfer shaft 7L moves along the second region 96Lc2 until the state shown in FIG. 25B is achieved.

During the above movement, the link part 96L does not rotate.

Consider a case where inertia occurs on the link part 96L as a result of closing the transfer unit 7 vigorously from the state shown in FIG. 24A to the state shown in FIG. 24B. The transfer unit 7 moves from a state shown in FIG. 25A to a state shown in FIG. 25B via a state in which the link part 96L cannot rotate, and thus it is possible to prevent the link part 96L and the transfer unit 7 from closing forcefully.

Figure 26A:
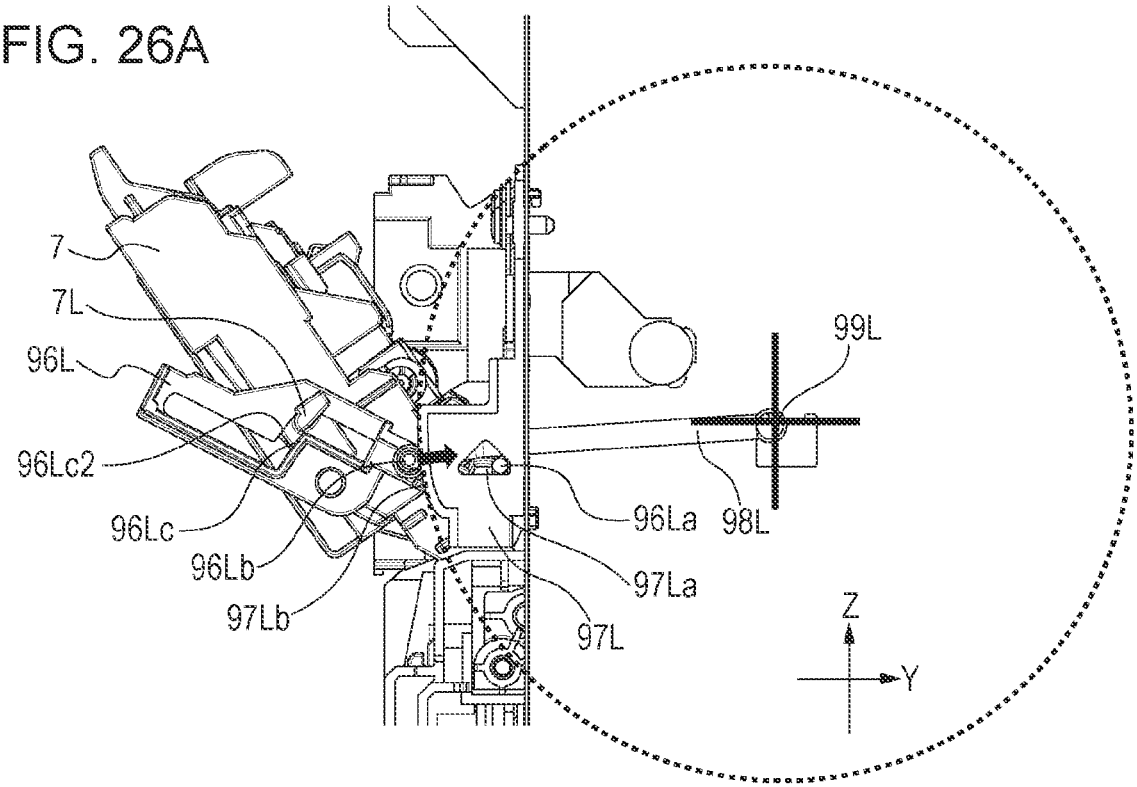
FIGS. 26A and 26B are cross-sectional views illustrating an operation of opening/closing a transfer unit (an operation of slightly closing the transfer unit from the state shown in FIGS. 25A and 25B).
Figure 26B:
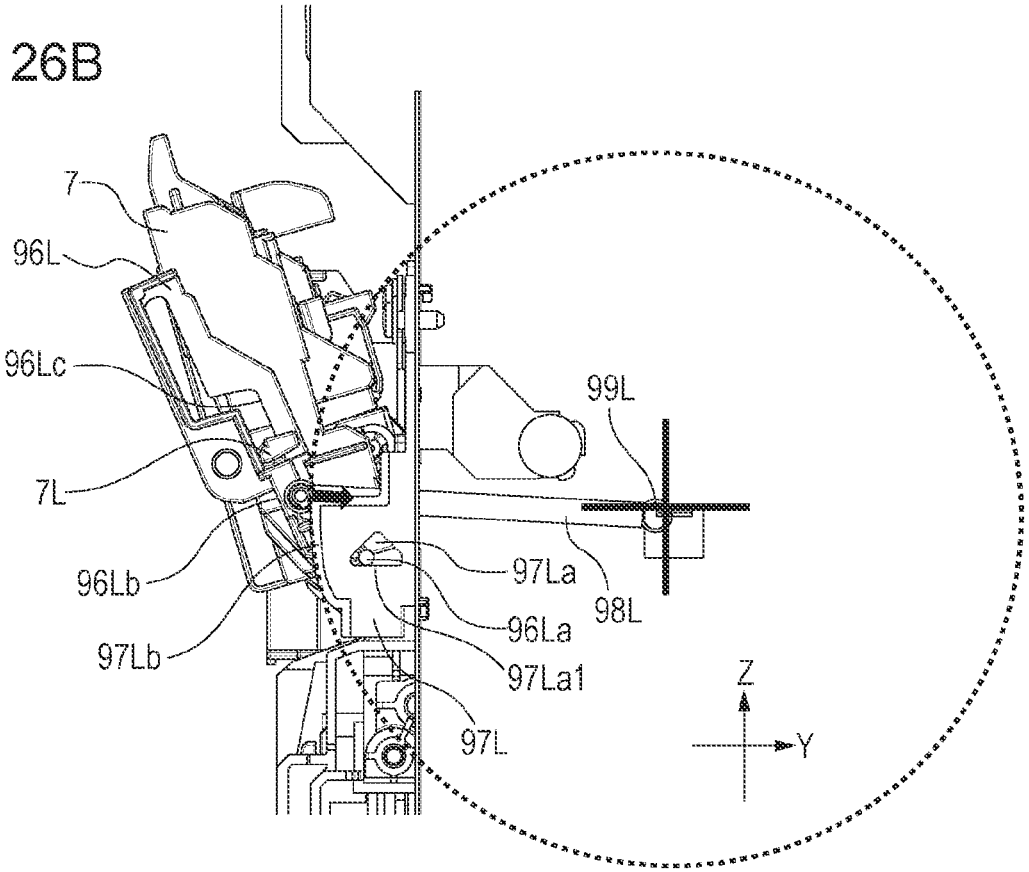

FIG. 26A and FIG. 26B show a manner in which the transfer unit 7 is closed from the state shown in FIG. 25B. The upper side of the link holder contact surface 97Lb has an arc shape centered on the supporting part 99L of the main body of the apparatus, and the direction in which the link shaft 96Lb is urged by the tension spring 98L is toward the supporting part 99L.

Therefore, in the transition from the state shown in FIG. 26A to the state shown in FIG. 26B, the force of the tension spring 98L acts on the link holder contact surface 97Lb, and thus the moment acting on the link part 96L in the closed direction becomes sufficiently small. Therefore, when the user closes the transfer unit 7, it is possible to operate the transfer unit 7 in a state in which the influence of the urging force of the tension spring 98L is reduced. Similarly, when the transfer unit 7 is opened from the state shown in FIG. 26B to the state shown in FIG. 26A, it is possible to operate the transfer unit 7 in a state in which the influence of the urging force of the tension spring 98L is reduced.

When the user closes the transfer unit 7, the link hole 96Lc is pressed against the transfer shaft 7L, and a clockwise moment occurs about the link shaft 96Lb. The link rotation center part 96La receives an upward reaction force from a lower surface 97La1 of the holding hole 97La (as seen on the figures), and thus a counterclockwise moment about the link shaft 96Lb occurs which is balanced with the previously described moment. The reaction force from the lower surface 97La1 causes the link shaft 96Lb to rise while contacting the link holder contact surface 97Lb.

Figure 27A:
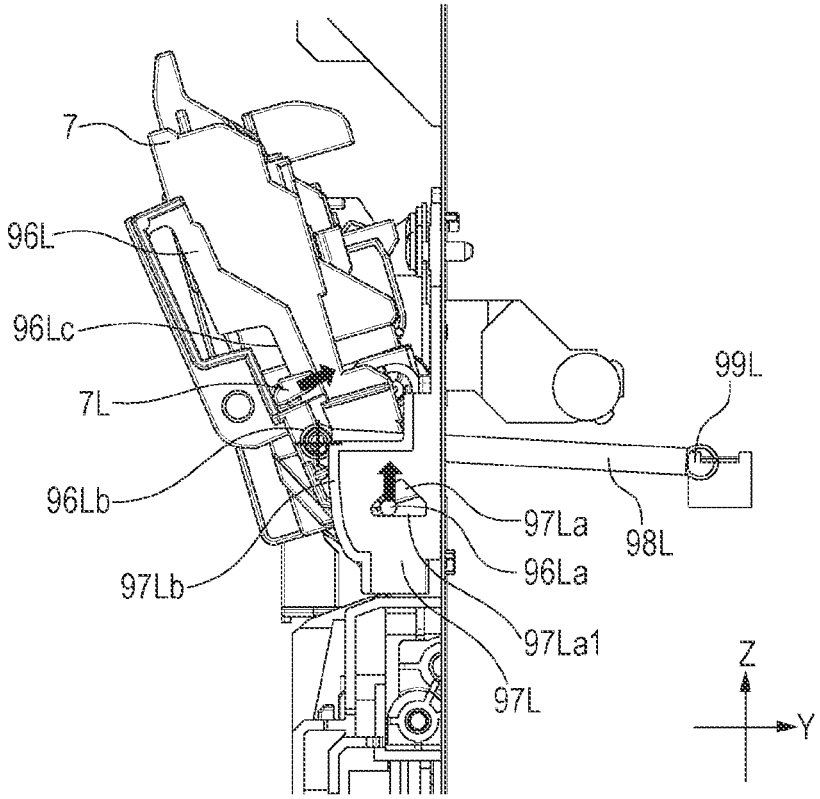
FIGS. 27A and 27B are cross-sectional views illustrating an operation of opening/closing a transfer unit (an operation of fully closing the transfer unit from the state shown in FIGS. 26A and 26B).
Figure 27B:
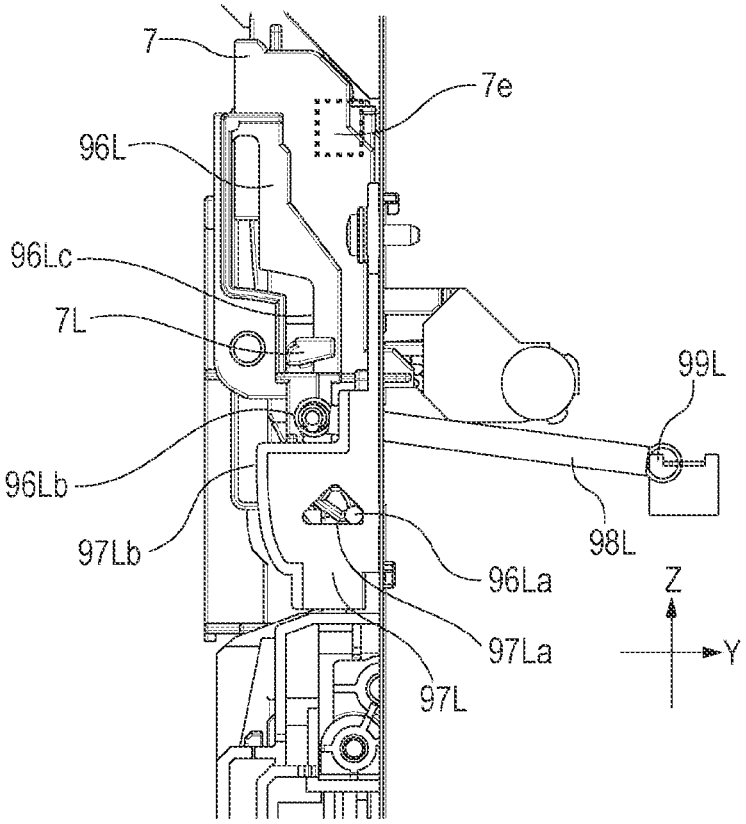

FIG. 27A and FIG. 27B illustrate a manner in which the transfer unit 7 is fully closed from the state shown in FIG. 26B. After the link shaft 96Lb passes over the upper side of the link holder contact surface 97Lb, there is no resistance to stop the force of the tension spring 98L toward the link shaft 96Lb, and thus a moment in the closing direction occurs on the link part 96L, and the transfer shaft 7L is pressed and the transfer shaft 7L is completely closed. In this state, the transfer unit 7 is in contact with the main body of the apparatus at a contact part 7*e*. The tension spring 98L urges link shaft 96Lb, and the link part 96L transmits the urging force to the rotation center part 96La and the link hole 96Lc. The urging force is transmitted from the link hole 96Lc to the transfer shaft 7L of the transfer unit 7, and the transfer unit 7 is urged against the main body of the apparatus via the contact part 7*e* and thus the transfer unit 7 is maintained in the closed state. In this state, the link shaft 96Lb is separated from the link holder contact surface 97Lb and the main body of the apparatus. As a result, the urging force of the tension spring 98L in the Y-direction can be efficiently transmitted to the transfer unit 7.

Figure 28A:
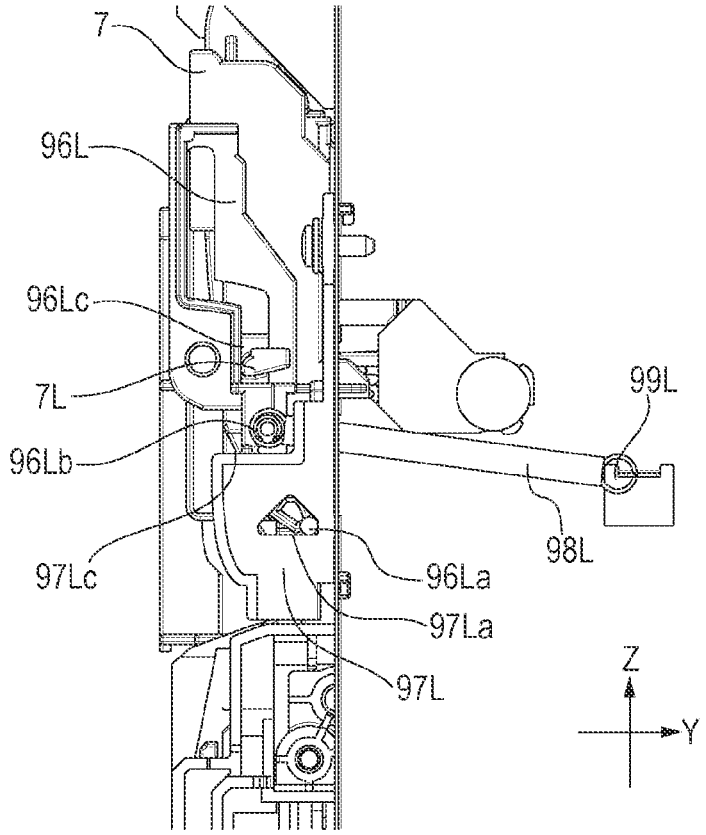
FIGS. 28A and 28B are cross-sectional views illustrating an operation of opening/closing a transfer unit (an operation of slightly opening the transfer unit from the completely closed state).
Figure 28B:
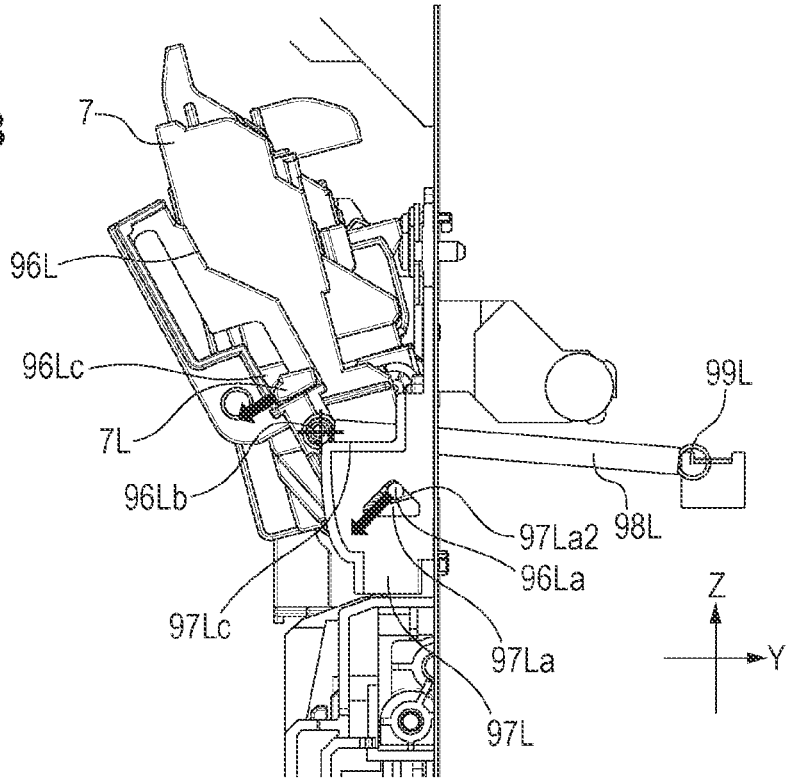

FIG. 28A and FIG. 28B illustrate a manner in which the transfer unit 7 is opened from the state shown in FIG. 27B. During the operation by the user to open the transfer unit 7, the link hole 96Lc is pressed against the transfer shaft 7L, and thus a counterclockwise moment about the link shaft 96Lb occurs. The link rotation center part 96La comes into contact with an upper right surface 97La2 of the holding hole 97La and thus the link rotation center part 96La receives a reaction force in a lower left direction (as viewed in FIGS. 28A and 28B), and a clockwise moment about the link shaft 96Lb occurs which is balanced with the previously described moment.

The reaction force from the holding hole 97La causes the link shaft 96Lb to move in the negative Y-direction while contacting an upper part of the contact surface 97Lc until the state shown in FIG. 26B is achieved. From this state, the process of fully opening the transfer unit 7 follows the reverse order of the process described above referring to FIGS. 24A, 24B, 25A, 25B, 26A, and 26B. As described above, in the states shown in FIGS. 24A, 24B, 25A, 25B, 26A, and 26B, the urging force applied to the link part 96L from the tension spring 98L is small. Therefore, the user can open and close the transfer unit 7 in the state in which the influence of the urging force is reduced.

In the present embodiment, as described above, when the transfer unit 7 is in a state between the open state and the closed state, the link shaft 96Lb and the link holder contact surface 97Lb are in contact with each other, and the link holder contact surface 97Lb receives the urging force from the link shaft 96Lb. When the transfer unit 7 is in the closed state, the link shaft 96Lb and the link holder contact surface 97Lb are separated from each other. That is, when the transfer unit 7 is in the closed state, the tension spring 98L efficiently transmits the urging force to the transfer unit 7. When the transfer unit 7 is in a state between the open state and the closed state, the link holder contact surface 97Lb receives the urging force.

Modifications

In the first embodiment described above, the link holder contact surface 97Lb includes the upper part (first surface part) having the arc shape centered on the supporting part 99L and the arc-shaped part (second surface part) centered on the link rotation center part 96La when the transfer unit 7 is in the open state, wherein the curvature of the first surface part is different from the curvature of the second surface part.

The shape of the link holder contact surface is not limited to the shape shown in the first embodiment as long as the link holder contact surface receives the link shaft 96Lb.

For example, the first surface part and the second surface part may be curved surfaces. That is, the first surface part and the second surface part may be arc-shaped curved surfaces, or may be non-arc-shaped curved surfaces.

Figure 29A:
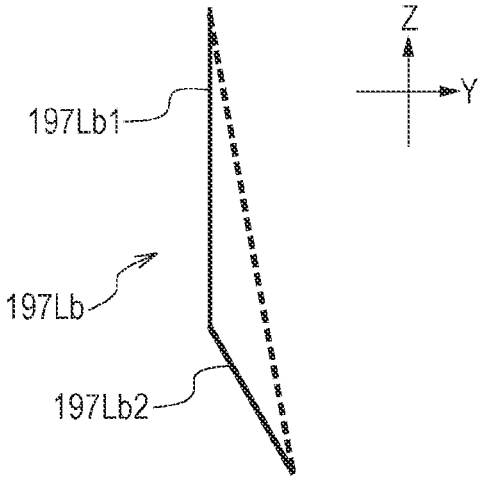
FIGS. 29A, 29B, and 29C are cross-sectional views of shapes of a contact part according to modifications.
Figure 29B:
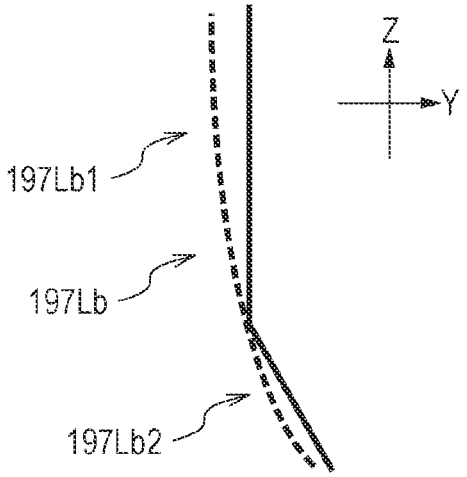
Figure 29C:
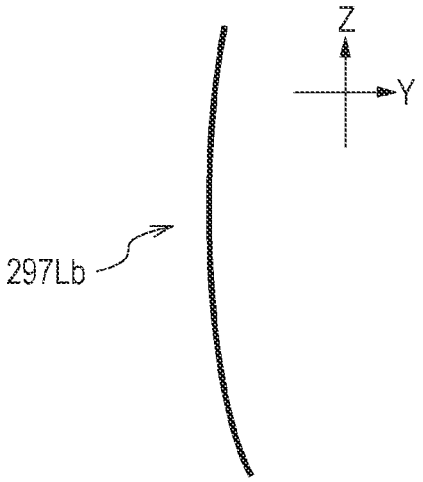

Other examples of the shape of the link holder contact surface are described below. FIGS. 29A to 29C are diagrams showing examples of shapes of the link holder contact surface according to modifications.

In the examples shown in FIGS. 29A and 29B, the link holder contact surface 197Lb has a first surface part 197Lb1 in the form of a flat surface and a second surface part 197Lb2 in the form of a flat surface. The second surface part 197Lb2 is inclined with respect to the first surface part 107Lb1. Note that the link holder contact surface 197Lb may be formed by a single surface, as represented by a broken line in FIG. 29A. As represented by a broken line in FIG. 29B, either one of the first surface part 197Lb1 and the second surface part 197Lb2 may be a curved surface. In this case, the curvature of the curved surface may be the same as that of the first surface part and the second surface part according to the first embodiment.

In the example shown in FIG. 29C, the link holder contact surface 297Lb has a curved surface (which may be an arc-shaped curved surface) with a constant curvature. In this case, the curvature of the curved surface may be the same as that of either one of the first surface part and the second surface part according to the first embodiment.

When the link holder contact surface 197Lb is formed so as to have one of the shapes described above, it is also possible to reduce the influence of the urging force of the tension spring 98L on the operating force to open and close the transfer unit 7. In summary, the link holder contact surface includes at least one of a flat surface and a curved surface. The link holder contact surface may include one flat surface part, or may include a plurality of flat surface parts. The link holder contact surface may include one curved surface part, or may include a plurality of curved surface parts. The link holder contact surface may include at least one flat surface part and at least one curved surface part.

According to the present disclosure, it is possible to reduce the influence of the urging force of the urging member that urges the opening and closing part on the operating force to open and close the opening and closing part.

Embodiments of the present disclosure can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described Embodiments and/or that includes one or more circuits (e.g., application specific integrated circuit (ASIC)) for performing the functions of one or more of the above-described Embodiments, and by a method performed by the computer of the system or apparatus by, for example, reading out and executing the computer executable instructions from the storage medium to perform the functions of one or more of the above-described Embodiments and/or controlling the one or more circuits to perform the functions of one or more of the above-described Embodiments. The computer may include one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read-only memory (ROM), a storage of distributed computing systems, an optical disk (such as a compact disc (CD), digital versatile disc (DVD), or Blu-ray Disc™ (BD)), a flash memory device, a memory card, and the like.

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of Japanese Patent Application No. 2021-166728 filed Oct. 11, 2021, which is hereby incorporated by reference herein in its entirety.

What is claimed is:

1. An image forming apparatus configured to form an image on a sheet, the image forming apparatus comprising:

a main body including a receiving surface and a first part;

an opening and closing part rotatable with respect to the main body between an open position and a closed position;

a link part connected to the main body and the opening and closing part, wherein the link part includes a second part engaged with the first part and includes a contact part; and an urging member connected to the link part and the main body and configured to urge the link part, wherein the link part is rotatable about the second part with respect to the main body, wherein, when the opening and closing part moves between the open position and the closed position, the second part moves with respect to the first part in a direction perpendicular to a direction along a rotating shaft of the link part thereby causing the contact part to come into contact with the receiving surface of the main body and further causing the contact part, urged by the urging member, to be received by the receiving surface of the main body, wherein the opening and closing part is capable of moving in a state in which the contact part of the link part and the receiving surface of the main body are in contact with each other, and wherein, when the opening and closing part is in the closed position, the contact part and the receiving surface are separated from each other, and the opening and closing part is urged toward the main body by the link part urged by the urging member.

2. The image forming apparatus according to claim 1, wherein the first part and the second part are in contact with each other when the opening and closing part is in the open position, and, when the opening and closing part moves between the open position and the closed position, the first part and the second part are separated from each other.

3. The image forming apparatus according to claim 1, wherein, in a state in which the opening and closing part is in the open position, a part of the receiving surface is formed along an arc centered on the first part.

4. The image forming apparatus according to claim 1, wherein the urging member is connected to a supporting part of the main body, and a part of the receiving surface is formed along an arc centered on the supporting part.

5. The image forming apparatus according to claim 1, wherein the link part has a link hole for transmitting a force received from the urging member to the opening and closing part, and the opening and closing part has a protruding part inserted in the link hole, wherein the link hole includes a first region extending in a first direction, a second region extending in a second direction, and a third region extending in a third direction, and wherein the second direction is a direction that intersects the first direction and the third direction.

6. The image forming apparatus according to claim 5, wherein, when the opening and closing part is in the open position, the protruding part is position in the first region, and, when the opening and closing part is in the closed position, the protruding part is position in the third region.

7. The image forming apparatus according to claim 5, wherein the second region extends so as to form an arc shape centered on a rotation center of the opening and closing part.

8. The image forming apparatus according to claim 1, wherein the second part is a shaft, and the first part is a receiving hole configured to receive the second part.

9. The image forming apparatus according to claim 1, wherein the opening and closing part includes a transfer roller configured to transfer a toner image to the sheet to form the image on the sheet.

10. The image forming apparatus according to claim 1, wherein the main body includes an image bearing member configured to bear an electrostatic latent image according to image information.

* * * * *